US010376076B2

(12) United States Patent
Alarcon et al.

(10) Patent No.: US 10,376,076 B2
(45) **Date of Patent: *Aug. 13, 2019**

(54) TRUSS BASED DISPLAY SYSTEM

(71) Applicant: Behr Process Corporation, Santa Ana, CA (US)

(72) Inventors: Michael E. Alarcon, Laguna Niguel, CA (US); Gregory James Warren, Costa Mesa, CA (US)

(73) Assignee: Behr Process Corporation, Santa Ana, CA (US)

( * ) Notice: Subject to any disclaimer, the term of this patent is extended or adjusted under 35 U.S.C. 154(b) by 239 days.

This patent is subject to a terminal disclaimer.

(21) Appl. No.: 15/429,236

(22) Filed: Feb. 10, 2017

(65) Prior Publication Data

US 2017/0150830 A1 Jun. 1, 2017

Related U.S. Application Data

(63) Continuation of application No. 14/504,708, filed on Oct. 2, 2014, now Pat. No. 9,565,953, which is a (Continued)

(51) Int. Cl.
*A47F 5/00* (2006.01)
*E04B 2/78* (2006.01)
(Continued)

(52) U.S. Cl.
CPC ..... *A47F 5/10* (2013.01); *A47B 45/00* (2013.01); *A47B 47/00* (2013.01);
(Continued)

(58) Field of Classification Search
CPC ..... E04B 2002/74; E04B 2002/7407; E04B 2002/7461; E04B 2002/7466;
(Continued)

(56) References Cited

U.S. PATENT DOCUMENTS 4,613,270 A 9/1986 Konstant et al.
4,730,739 A 3/1988 Semerau, Jr.
(Continued)

OTHER PUBLICATIONS

Form PCT/ISA/210 in connection with PCT/US2011/050090 dated Feb. 29, 2012.
(Continued)

*Primary Examiner* — Willliam V Gilbert
(74) *Attorney, Agent, or Firm* — Harness, Dickey & Pierce, P.L.C.

(57) ABSTRACT

An adjustable truss structure for a display is provided and includes a vertical truss member, a vertical channel having a vertical slot therein, the vertical channel being attached to the vertical truss member, and a horizontal rail having a horizontal slot. An anchor is attached to the horizontal rail. The anchor has a member rotatable to a first position where the member is insertable into the vertical slot and rotatable to a second position to engage with a surface of the vertical channel, thereby enabling the horizontal rail to be selectively moved up and down the vertical channel and locked into a selected fixed position with respect to the vertical channel. A support member has a channel with a U-shaped cross-section, the channel being hooked into the horizontal slot of the horizontal rail and being horizontally slidable in the horizontal slot.

10 Claims, 44 Drawing Sheets

Related U.S. Application Data continuation of application No. 14/207,325, filed on Mar. 12, 2014, now Pat. No. 8,881,467, which is a continuation of application No. 13/223,000, filed on Aug. 31, 2011, now Pat. No. 8,689,493.

(60) Provisional application No. 61/379,247, filed on Sep. 1, 2010.

(51) Int. Cl.

| | |
|---|---|
| ***A47F 5/10*** | (2006.01) |
| ***A47F 7/00*** | (2006.01) |
| ***A47B 45/00*** | (2006.01) |
| ***A47B 47/00*** | (2006.01) |
| ***A47B 96/14*** | (2006.01) |
| ***E04C 3/08*** | (2006.01) |
| ***E04C 3/32*** | (2006.01) |

(52) U.S. Cl.

CPC ..... *A47B 96/1441* (2013.01); *A47B 96/1466* (2013.01); *A47F 5/00* (2013.01); *A47F 5/0018* (2013.01); *A47F 7/00* (2013.01); *E04B 2/78* (2013.01); *E04C 3/08* (2013.01); *E04C 3/32* (2013.01); *A47F 2005/0075* (2013.01)

(58) Field of Classification Search

CPC ..... E04B 2002/828; E04H 1/1222; E04H 1/1272; A47F 3/004

USPC ..... 52/36.1, 36.2, 238.1–243.1; 312/234; 211/190, 193, 206

See application file for complete search history.

(56) References Cited

U.S. PATENT DOCUMENTS

| | | | |
|---|---|---|---|
| 5,316,157 | A | 5/1994 | Konstant |
| 5,495,952 | A | 3/1996 | Kainz |
| 5,890,325 | A | 4/1999 | Corcorran et al. |
| 5,930,963 | A | 8/1999 | Nichols |
| 6,115,978 | A | 9/2000 | Bastian et al. |
| D481,882 | S | 11/2003 | Richardson et al. |
| D481,883 | S | 11/2003 | Richardson et al. |
| D481,884 | S | 11/2003 | Richardson et al. |
| D482,207 | S | 11/2003 | Richardson et al. |
| D488,001 | S | 4/2004 | Richardson et al. |
| D488,318 | S | 4/2004 | Richardson et al. |
| D488,633 | S | 4/2004 | Richardson et al. |
| D493,045 | S | 7/2004 | Richardson et al. |
| D497,269 | S | 10/2004 | Richardson et al. |
| D497,495 | S | 10/2004 | Richardson et al. |
| D502,222 | S | 2/2005 | Richardson et al. |
| D519,115 | S | 4/2006 | Lee et al. |
| 7,040,064 | B2 | 5/2006 | Fritsche et al. |
| D526,819 | S | 8/2006 | Lee et al. |
| D527,207 | S | 8/2006 | Lee et al. |
| D527,934 | S | 9/2006 | Lee et al. |
| D528,835 | S | 9/2006 | Lee et al. |
| D532,416 | S | 11/2006 | Lee et al. |
| 7,143,553 | B2 | 12/2006 | Fritsche et al. |
| 7,150,127 | B2 | 12/2006 | Underwood et al. |
| 7,204,376 | B2 | 4/2007 | Richardson et al. |
| D557,041 | S | 12/2007 | Lee et al. |
| 7,308,987 | B2 | 12/2007 | Richardson et al. |
| 7,360,915 | B2 | 4/2008 | Richardson et al. |
| 7,571,823 | B2 | 8/2009 | Richardson et al. |
| 7,604,132 | B2 | 10/2009 | Richardson et al. |
| 7,641,474 | B2 | 1/2010 | Rice |
| 7,789,472 | B2 | 9/2010 | Richardson et al. |
| 8,689,493 | B2 | 4/2014 | Alarcon et al. |
| 8,776,446 | B1 | 7/2014 | Jhaveri et al. |
| 8,881,467 | B2 | 11/2014 | Alarcon et al. |
| 9,565,953 | B2 | 2/2017 | Alarcon et al. |
| 2004/0118054 | A1 | 6/2004 | Thompson |
| 2005/0102918 | A1 | 5/2005 | Richardson et al. |
| 2007/0109315 | A1 | 5/2007 | Rice |
| 2008/0236053 | A1 | 10/2008 | Adams et al. |

OTHER PUBLICATIONS

Form PCT/ISA/237 in connection with PCT/US2011/050090 dated Feb. 29, 2012.

TRUSS BASED DISPLAY SYSTEM

CROSS REFERENCE TO RELATED APPLICATIONS

This application is a continuation of U.S. patent application Ser. No. 14/504,708, entitled "TRUSS BASED DISPLAY SYSTEM," filed Oct. 2, 2014, and issuing as U.S. Pat. No. 9,565,953, which is a continuation of U.S. patent application Ser. No. 14/207,325, filed Mar. 12, 2014, with the same title, and issued as U.S. Pat. No. 8,881,467, which application is a continuation of U.S. patent application Ser. No. 13/223,000, with the same title, filed Aug. 31, 2011, and issued as U.S. Pat. No. 8,689,493, which claims the benefit of and priority to U.S. Provisional Application Ser. No. 61/379,247, filed Sep. 1, 2010, with the same title. The contents of each of the aforesaid applications and patents are incorporated by reference herein in their entirety.

BACKGROUND

Field

The subject disclosure relates to display systems and more particularly to a large display structure useful in retail display environments and featuring easily assembleable, changeable, movable, and replaceable components. Such a display may be particularly adapted in various embodiments to display paint and other coating products, as well as advertising and interactive digital displays.

Related Art

Display assemblies have been used for displaying various items in retail environments. One example of such display assemblies is presented in U.S. Pat. No. 7,789,472 assigned to the present assignee, Behr Process Corporation.

SUMMARY

A display system according to one illustrative embodiment of the present disclosure comprises a plurality of vertical truss members anchored to a floor surface and a plurality of horizontal rails attached across the vertical truss members thereby forming a frame. In one embodiment, a horizontal track may be anchored to a floor surface in front of the vertical truss members, and a plurality of cantilever supports are attached across the top of the frame.

In one embodiment, the cantilever supports each have a front portion providing an upper frame and a lower frame. A plurality of upper rectangular display panels are mounted in a first row adjacent one another in the upper frames and a plurality of lower rectangular display panels are mounted adjacent one another in the lower frames in a second row below the first row.

In one embodiment, first and second side panels are anchored to the floor track and to a plurality of the horizontal rails, and a plurality of cabinets are located adjacent one another between the first and second side panels and anchored to the floor track and at least one of the horizontal rails.

DRAWINGS

The illustrative embodiments of the subject disclosure will now be described in detail in conjunction with the drawings, of which:

DETAILED DESCRIPTION

Figure 1:
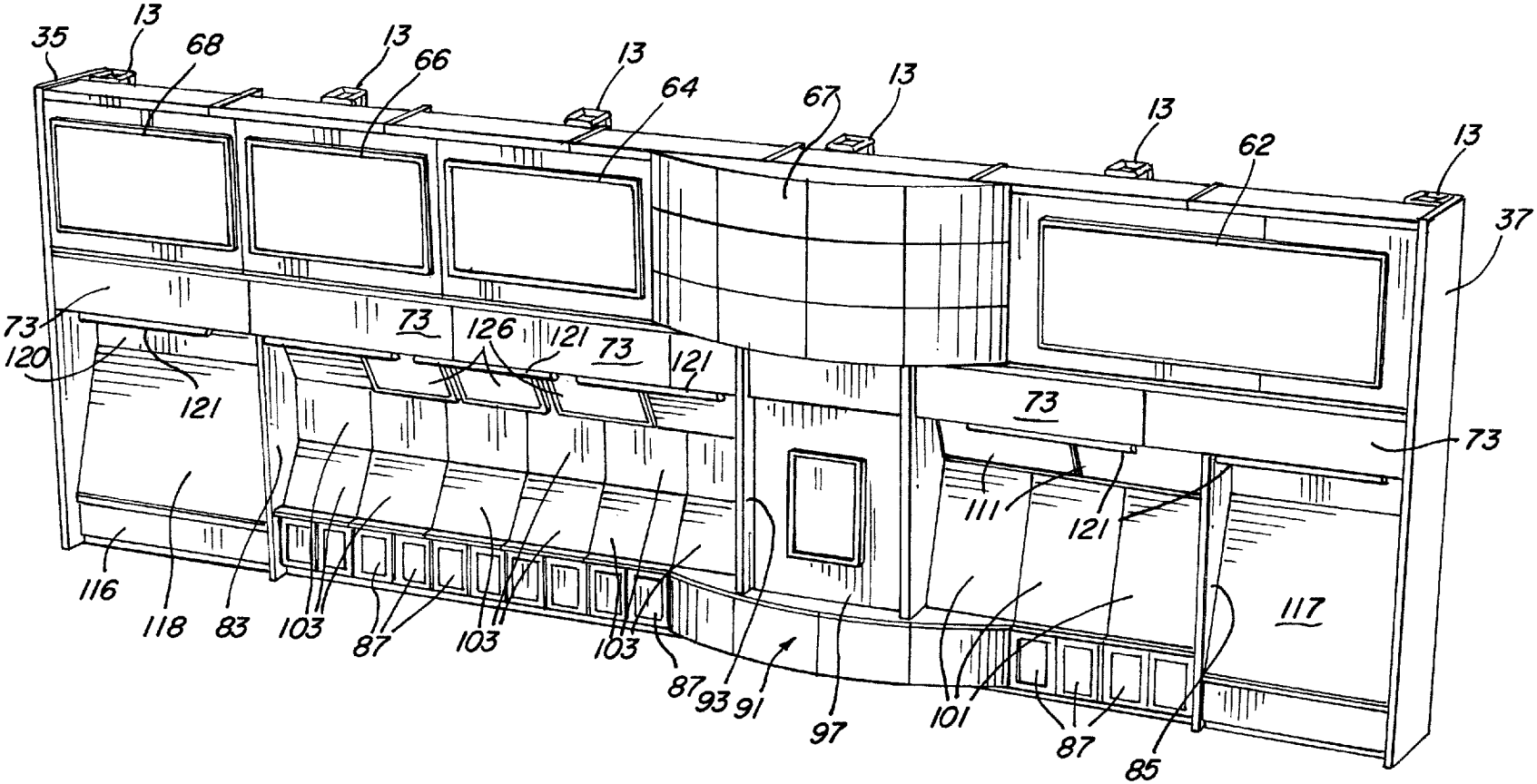
FIG. 1 is a perspective view of an illustrative embodiment.
Figure 2:
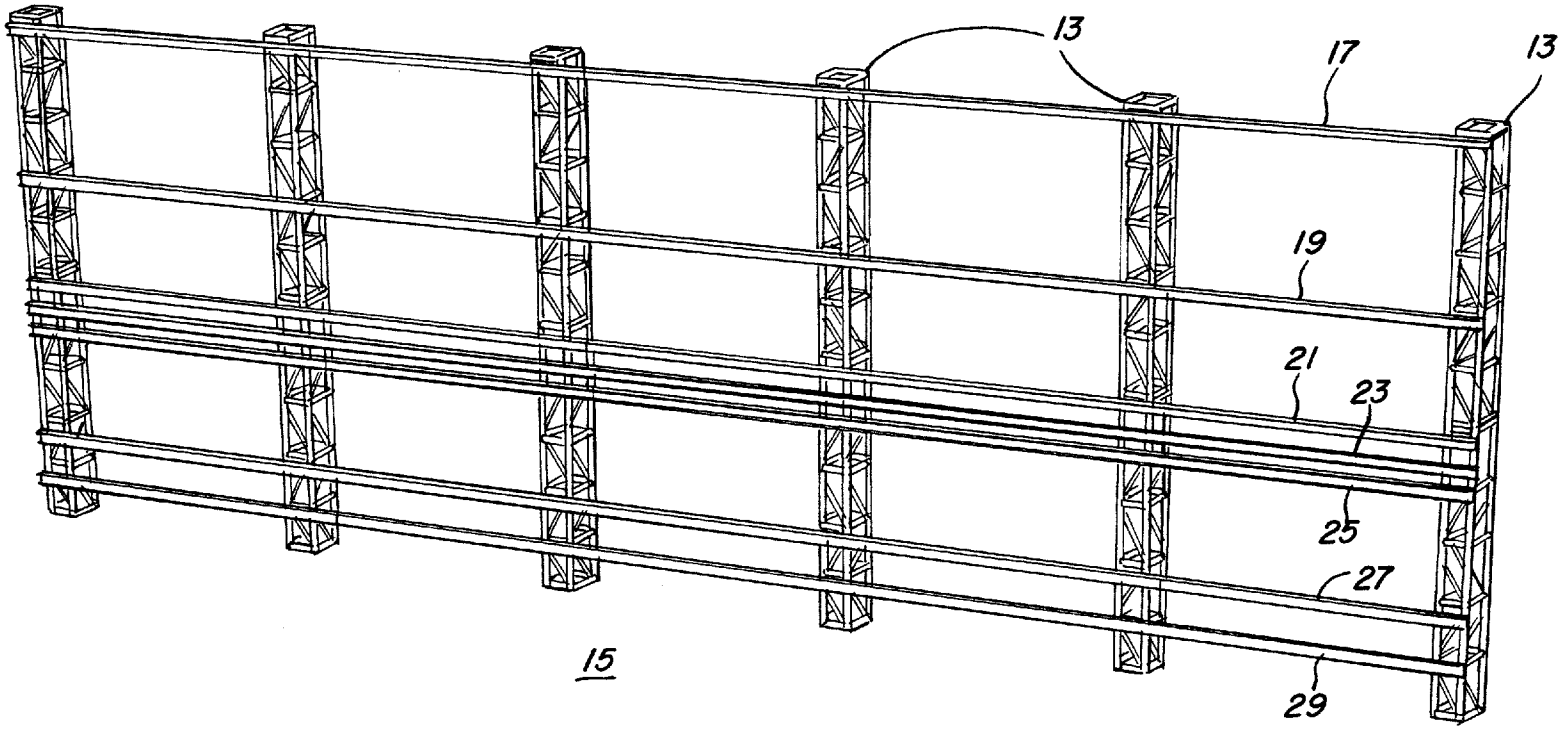
FIG. 2 is a perspective view illustrating a plurality of horizontal rails or bars attached across vertical truss members according to an illustrative embodiment truss.

FIG. 1 is a perspective view of one illustrative embodiment of a display. FIGS. 1 through 35 illustrate a step-by-step construction of the embodiment of FIG. 1.

Figure 3:
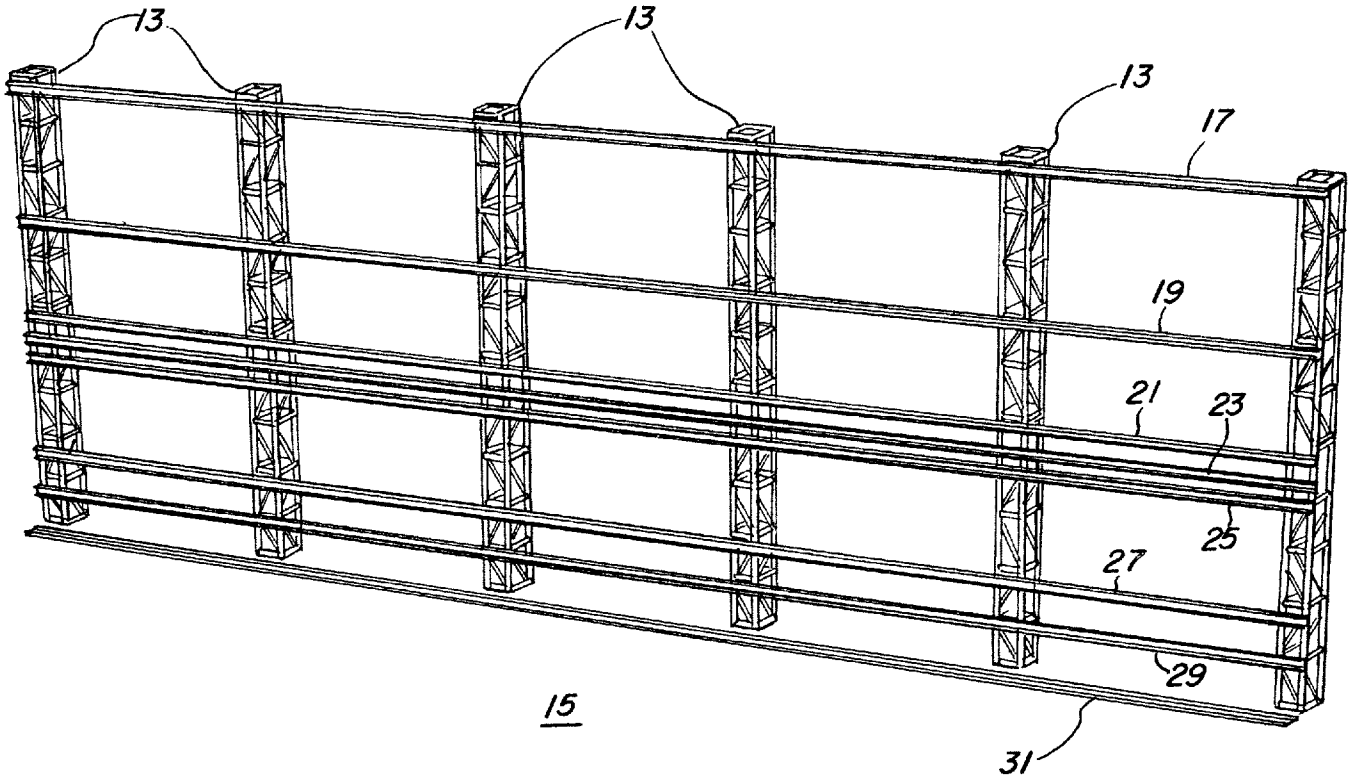
FIG. 3 is a perspective view illustrating a horizontal floor track added to the structure of FIG. 2.
Figure 4:
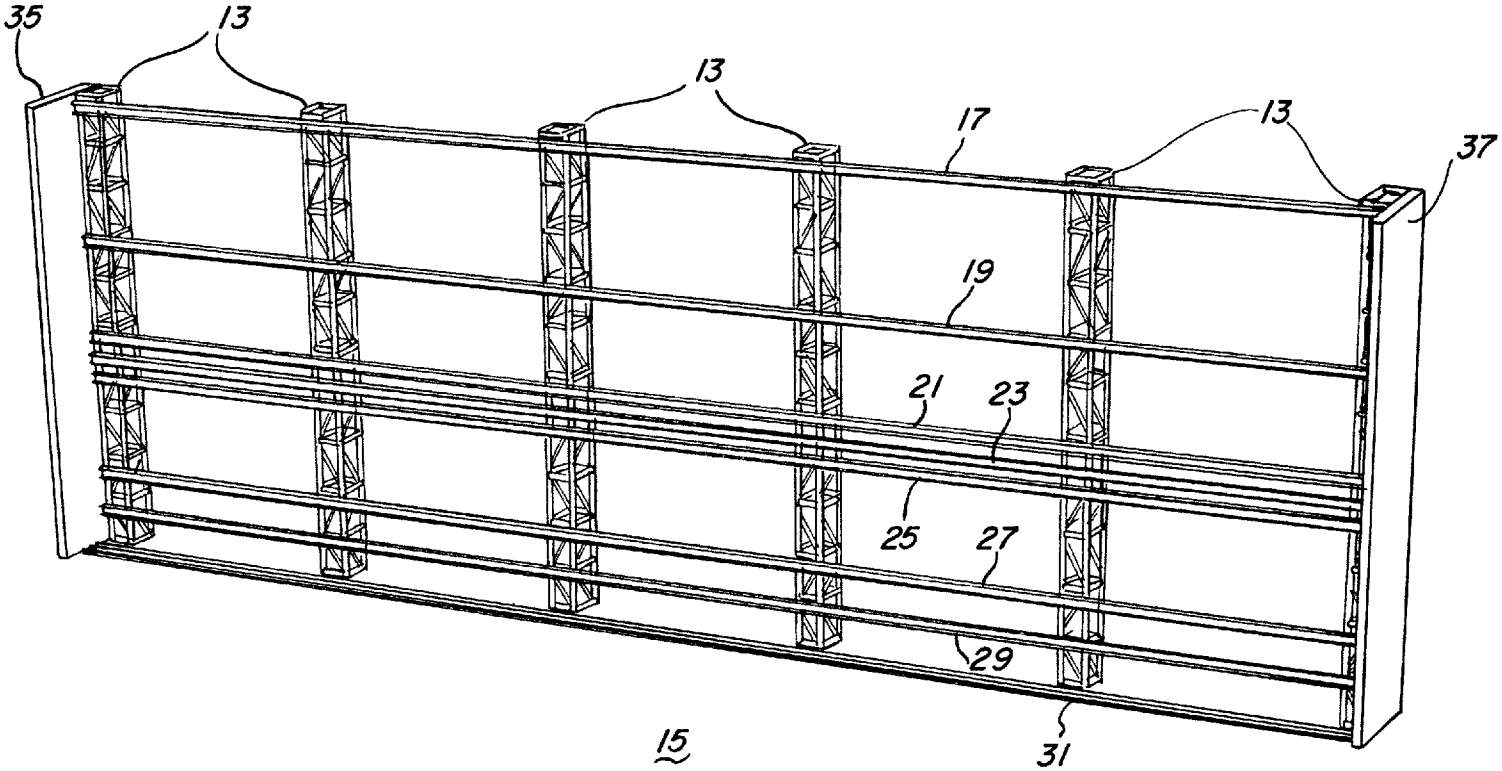
FIG. 4 is a perspective view illustrating the addition of vertical end panels to the structure of FIG. 3.

As shown in FIG. 1, an illustrative embodiment includes a number of vertical metal truss members 13, which may be anchored to the floor surface 15 using suitable anchor plates or other mechanisms. In some embodiments, the truss members may comprise aluminum or steel tubing of various shapes, such as, for example, round, square, or rectangular. As further shown in FIGS. 1-4, a number of rectangular horizontal metal rails or bars 17, 19, 21, 23, 25 27, 29 are fastened to the vertical truss members 13 and are positioned to facilitate attachment of other components of the structure. A horizontal floor track 31 is then added and is fastened to the bottom front edges of the truss members 13 and to the floor 15 (FIG. 3). The track 31 may contain a horizontal groove or channel 33 extending over its entire length to facilitate attachment of other componentry. Vertical rectangular end panels 35, 37 are then fastened to the respective end most ones of the vertical trusses 13 (FIG. 4).

Figure 5:
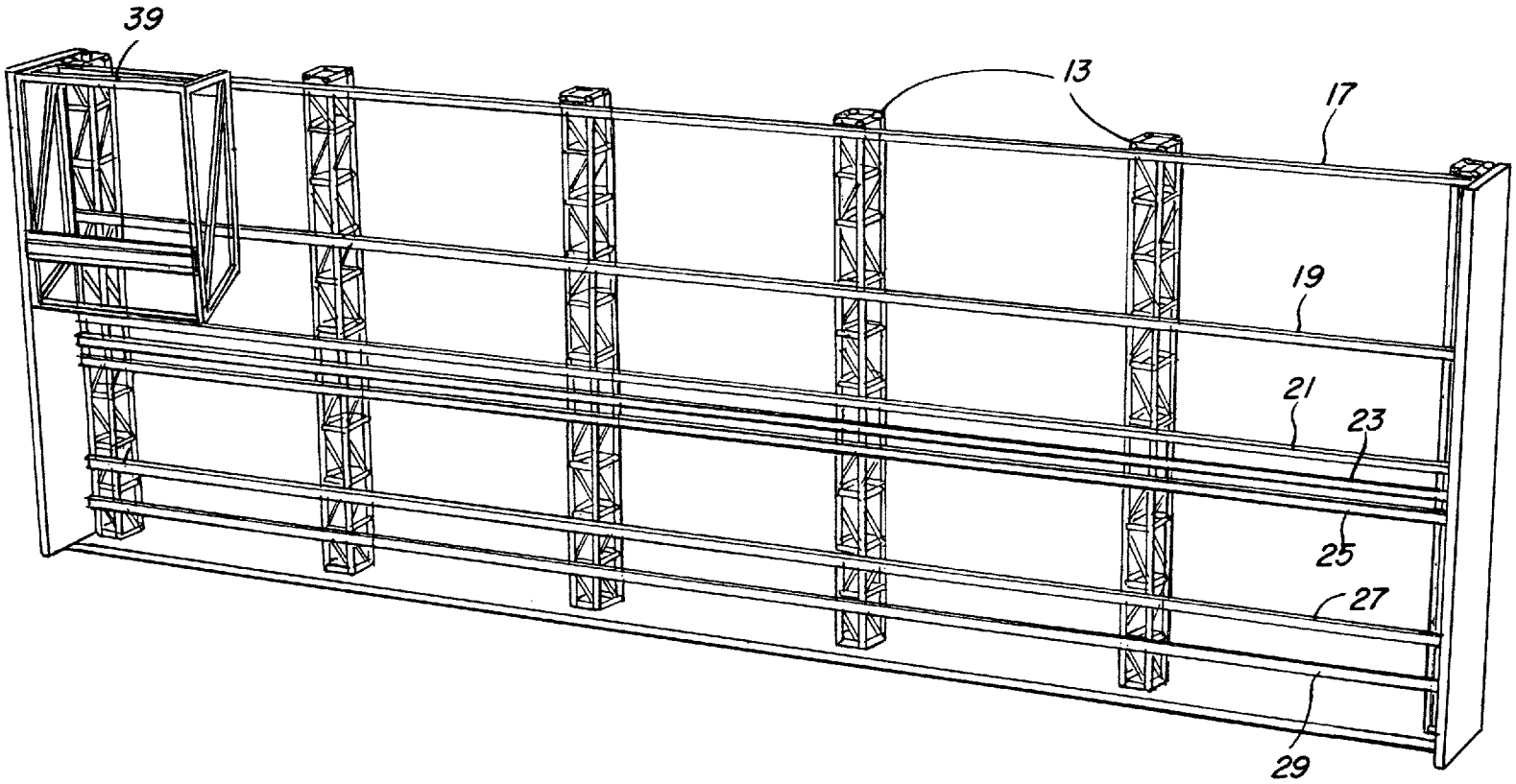
FIG. 5 is a perspective view illustrating a cantilever display panel support attached to the structure of FIG. 4.
Figure 6:
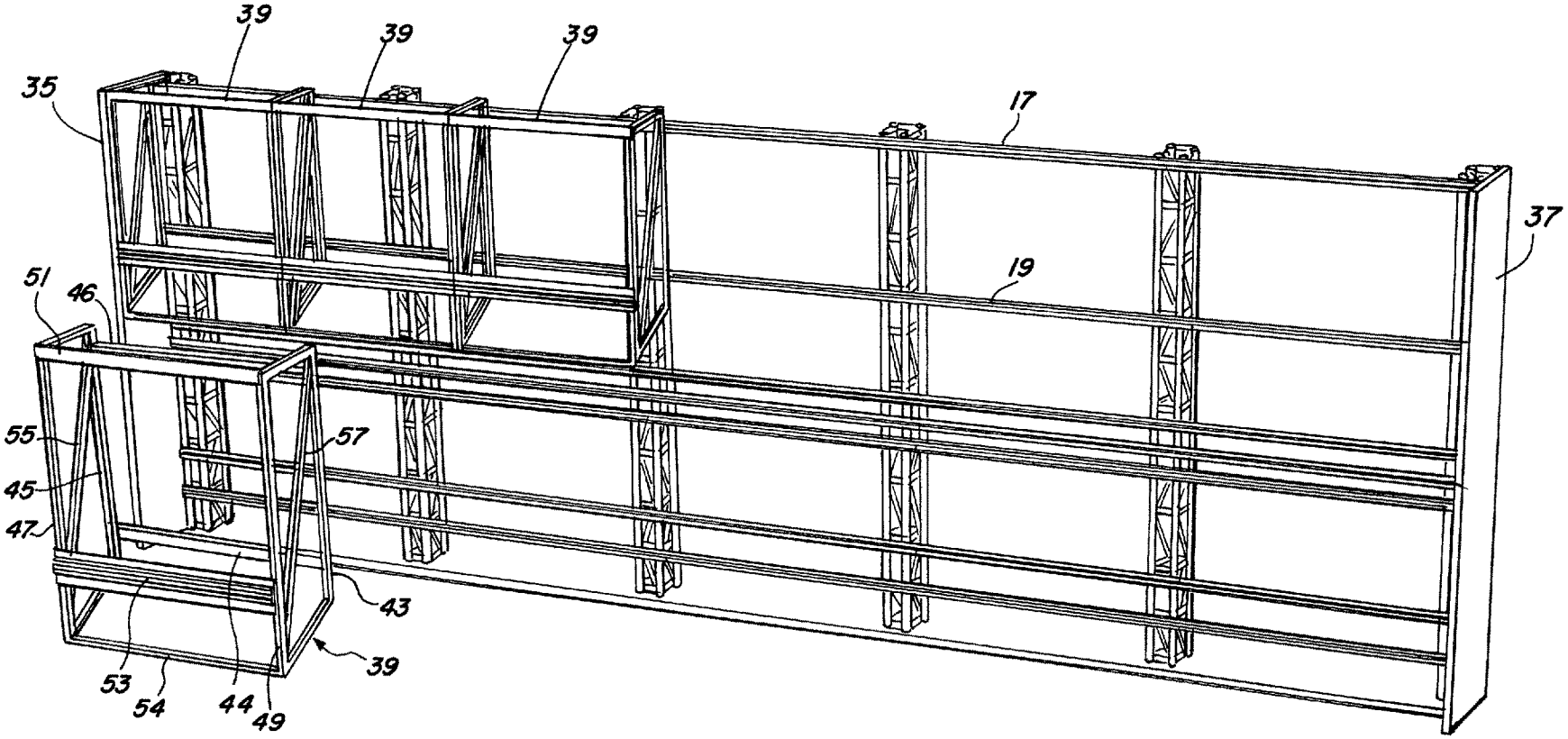
FIGS. 6 and 7 are perspective views illustrating further details of the cantilever supports.
Figure 7:
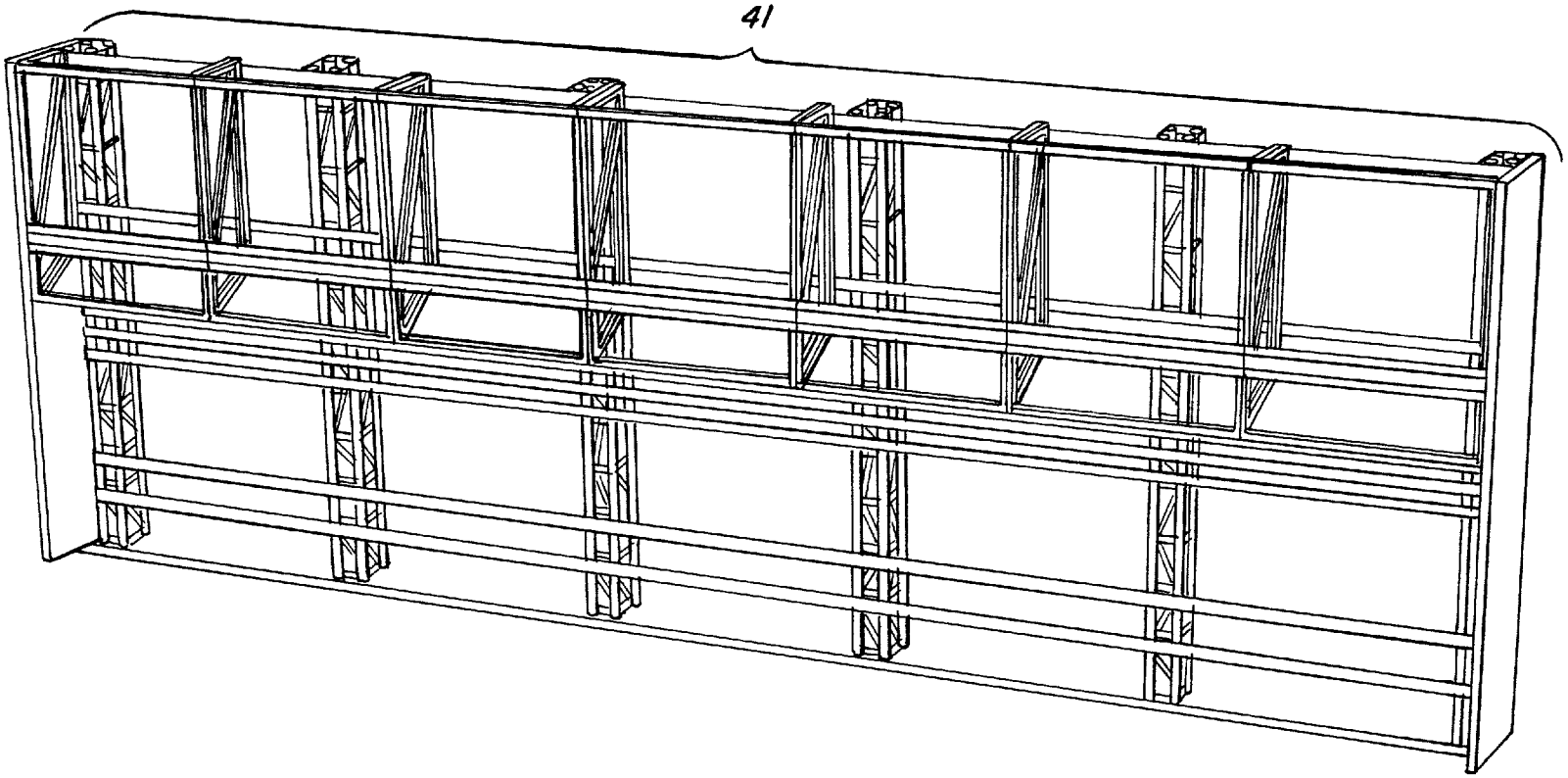
Figure 8:
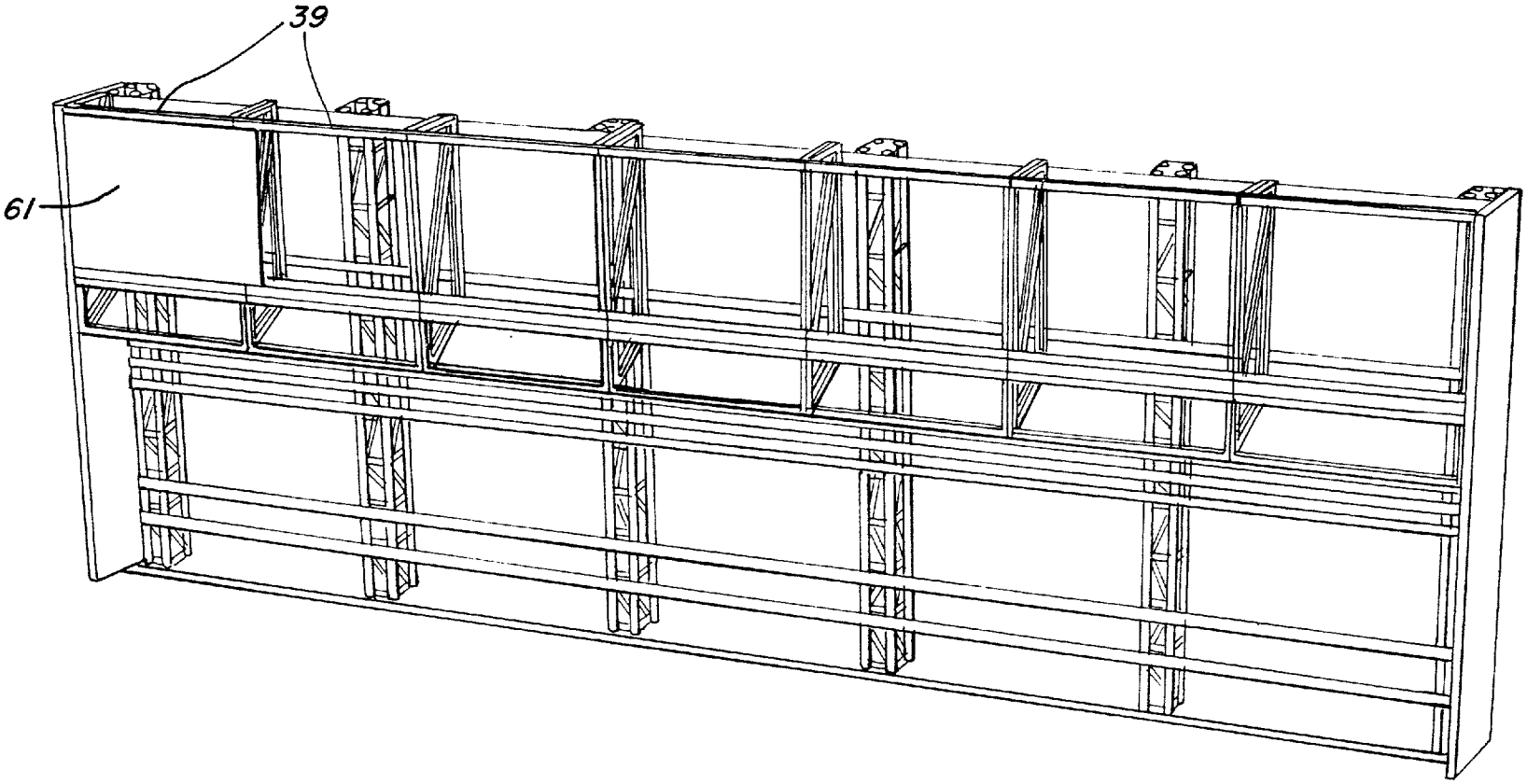
FIGS. 8-11 are perspective views illustrating installation of top trim panels into the cantilever supports.
Figure 9:
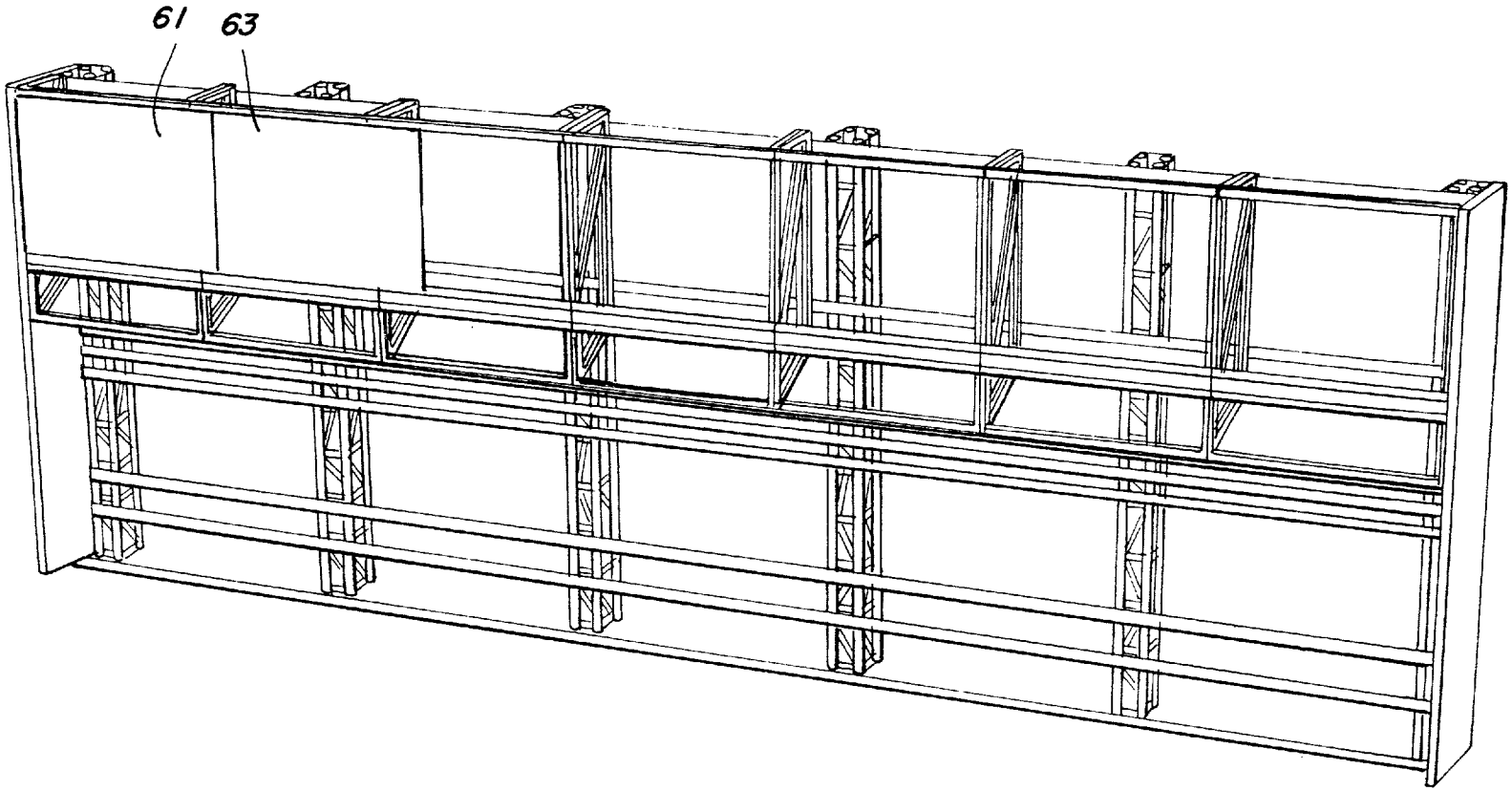
Figure 10:
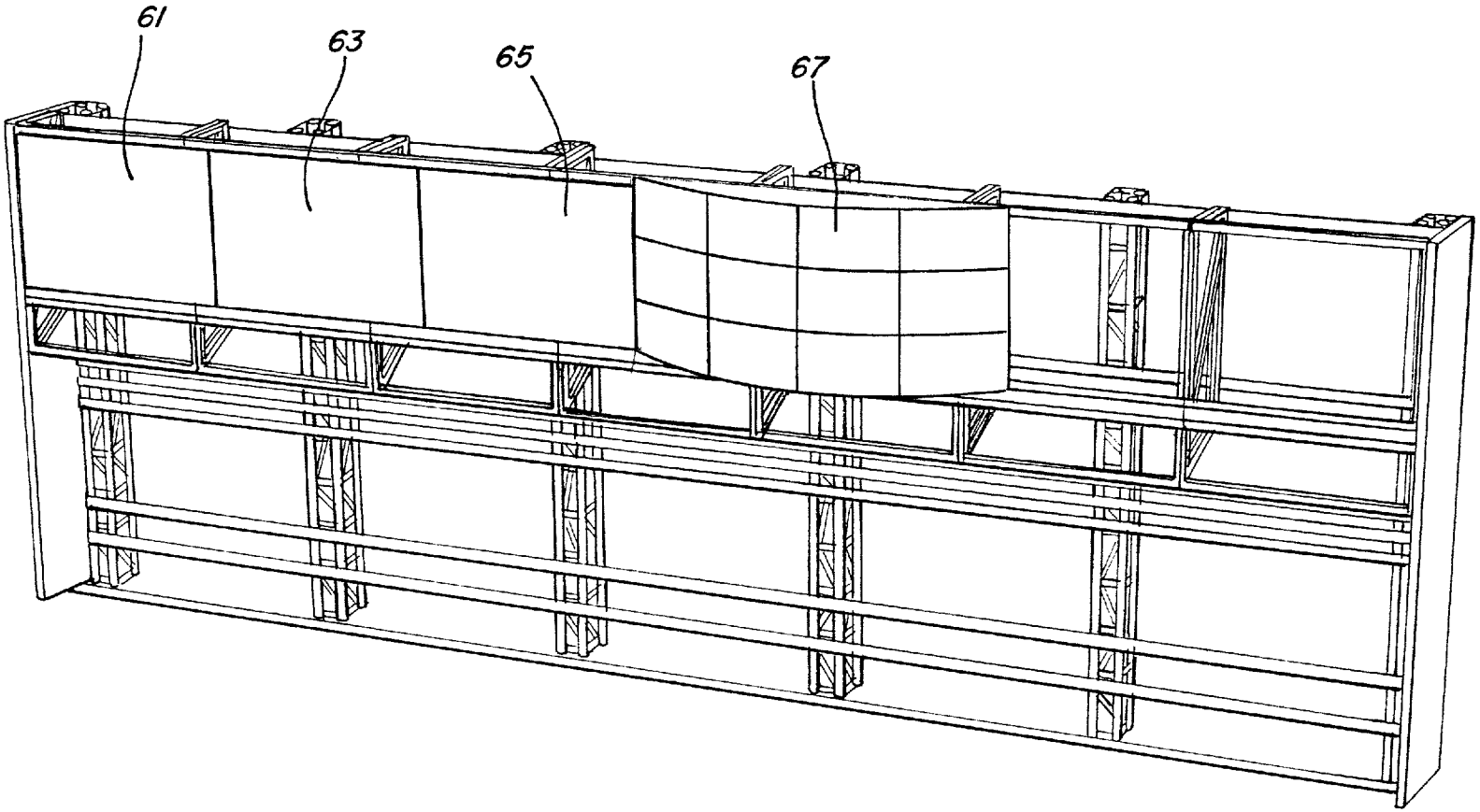
Figure 11:
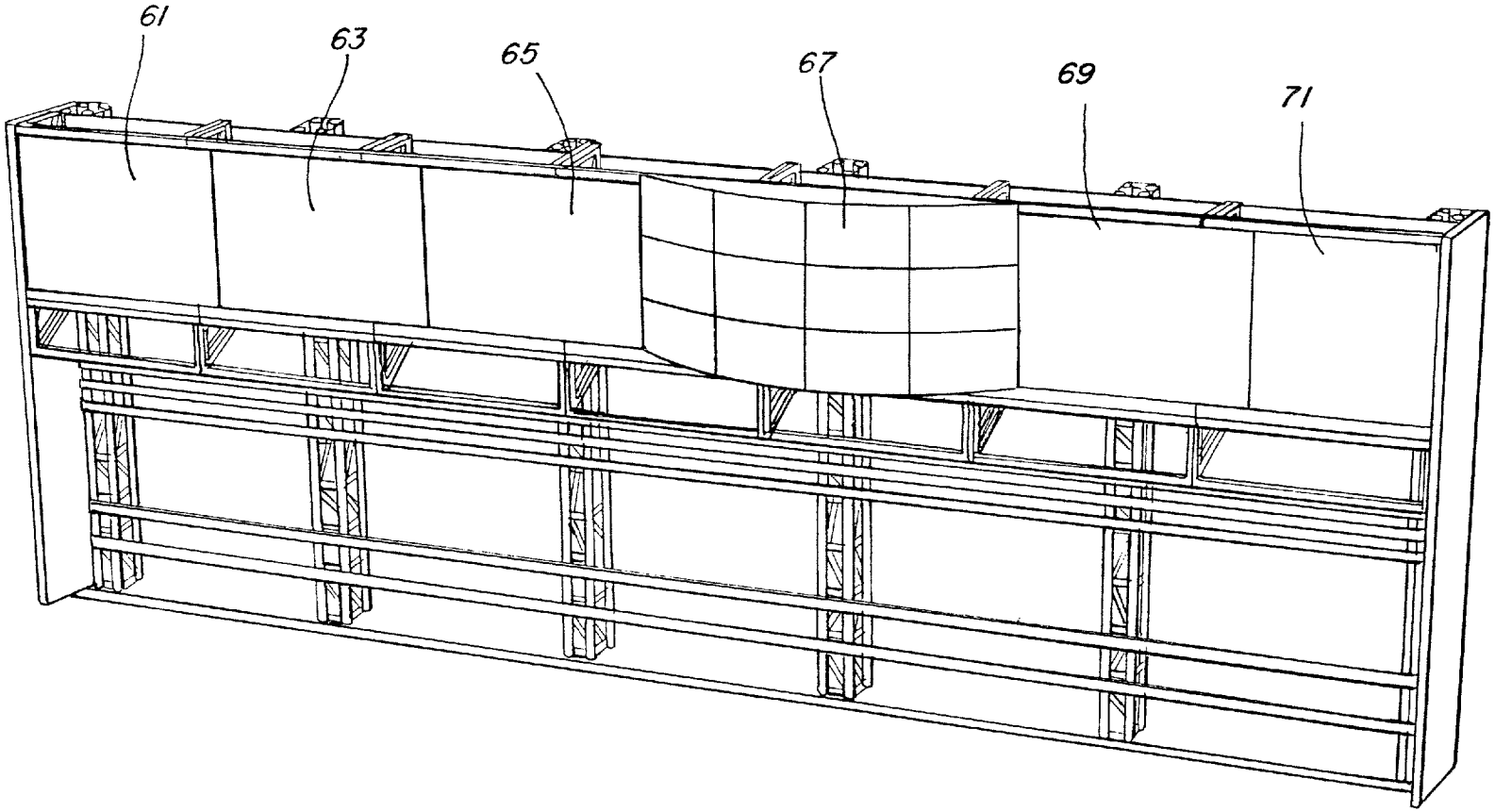

FIGS. 5-7 illustrate the attachment of cantilever supports 39 to form a cantilevered upper support section 41 of the structure. Each cantilever support 39 has vertical rear frame members 43, 45, and horizontal rear frame members 44, 46, which are fastened to the top two horizontal members 17, 19 by suitable fastening mechanisms. In one embodiment, a "quick disconnect mechanism may be used. Each support 39 additionally has vertical front frame members 47, 49, to which are attached rectangular horizontal panel support members 51, 53, 54. Each cantilever support 39 further includes diagonal side braces 55, 57.

As shown in FIGS. 8-11, top trim panels 61, 63, 65, 67, 69, 71 are then added in a row across the top of the structure. Each panel, e.g. 61, fits within, i.e., is framed by the top and middle horizontal panel support members 51, 53 of the cantilever supports 39. In one embodiment, each panel is lifted up and into a channel in upper track 51 and then drops down into the lower channel 53 and may thereafter be slid to the left or right. Panel 67 comprises a design element having an arcuate front surface or "bump out" and fits into the cantilever frames in the same manner as the other panels 61, 63, 65, 69, 71. Panels such as those illustrated may carry display advertising.

The structure shown in FIGS. 8-11 permits re-ordering (and re-positioning) of the panels 61-71 as desired by moving or sliding the panels to new positions. As an example, the "bump out" panel 67 can be moved or slid toward the left end of the display or toward the right to accommodate various store environments. The panels 61-71 can also be easily changed out or replaced to substitute new panels, which may comprise part of a new trim package, in order, for example, to add a new or updated "look" to the display.

Figure 12:
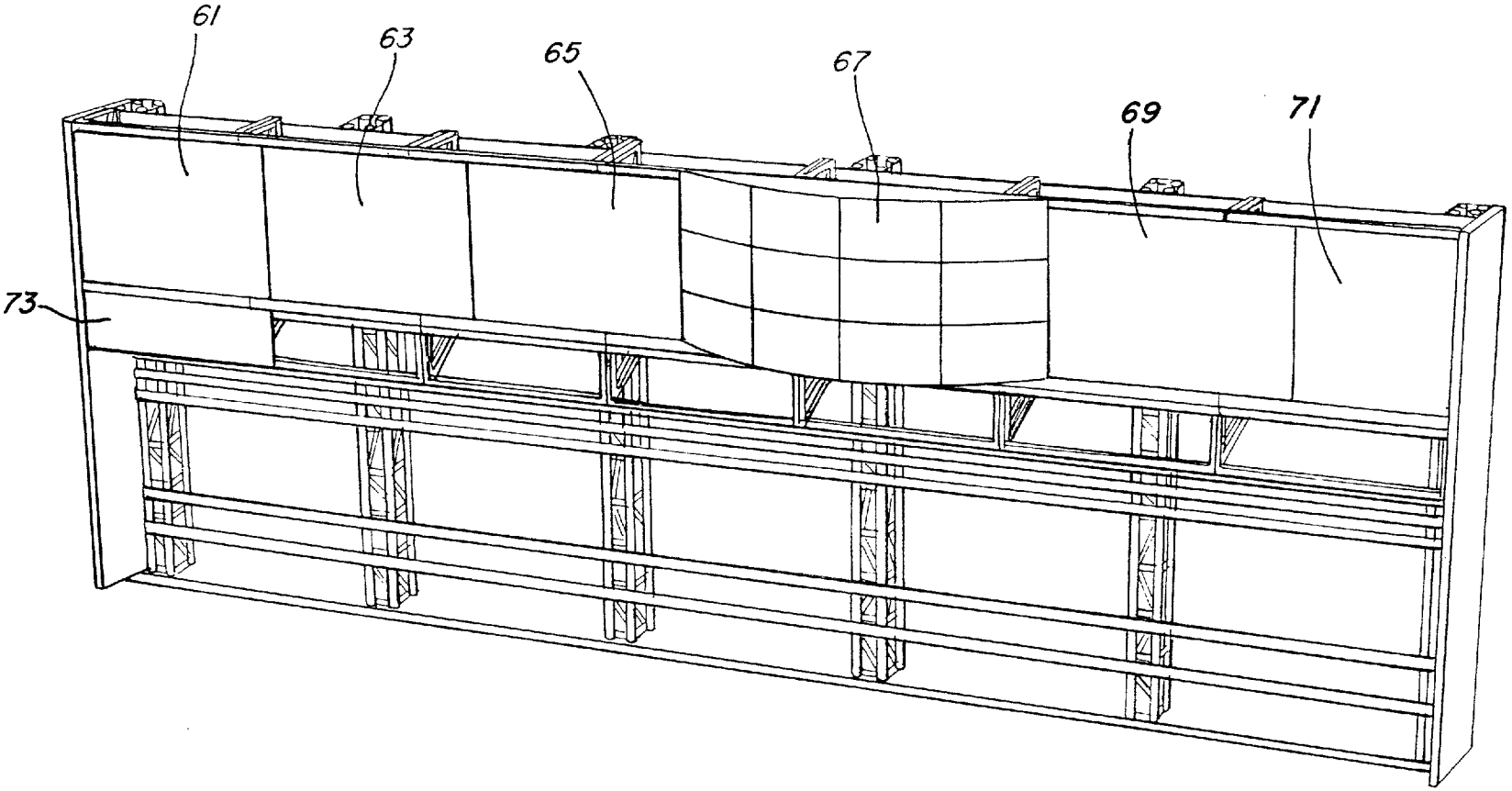
FIGS. 12-14 are perspective views illustrating installation of intermediate trim panels into the cantilever supports.
Figure 13:
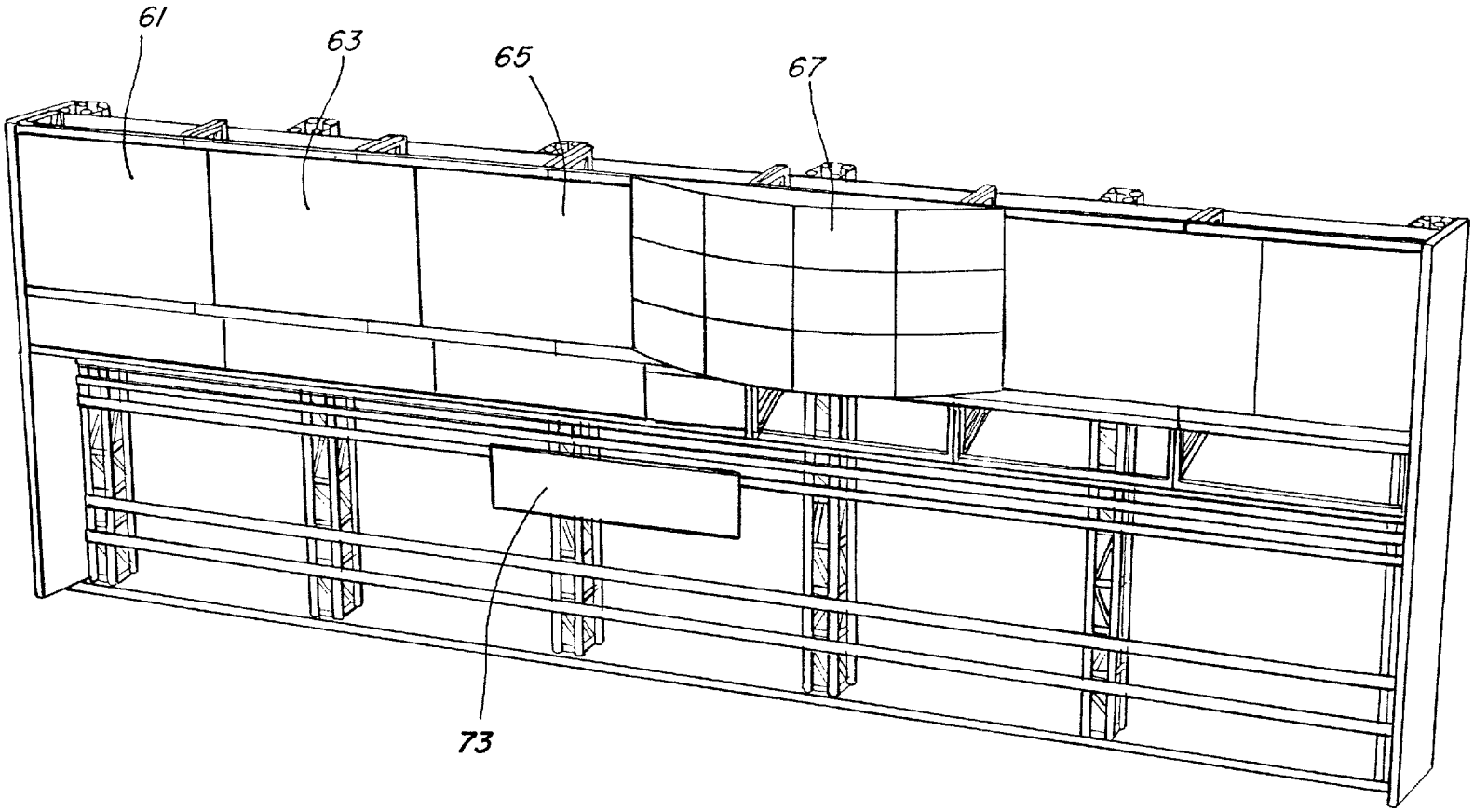
Figure 14:
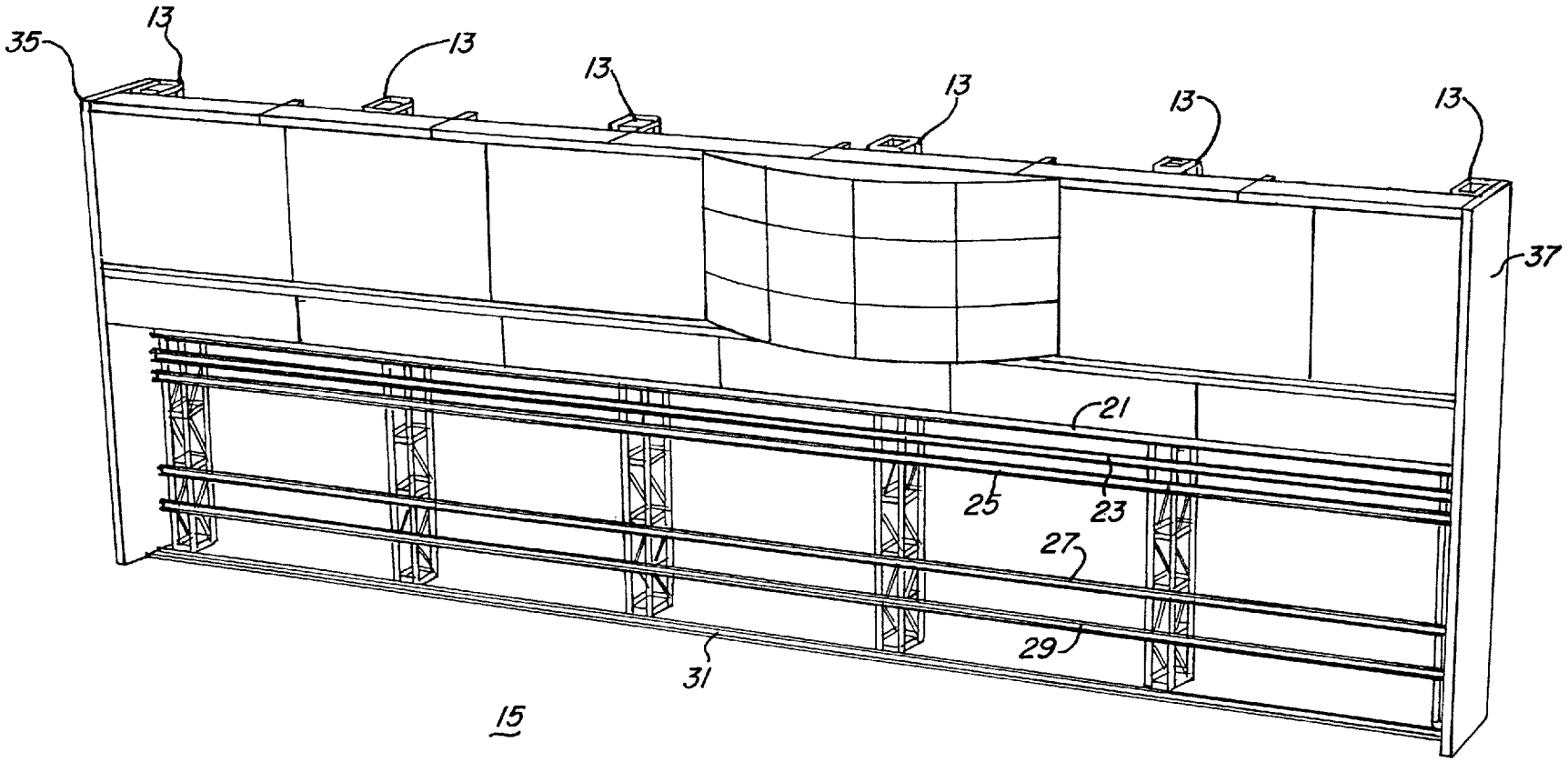

Next, as shown in FIGS. 12-14, rectangular intermediate trim panels 73 are inserted adjacent one another in a row into the frame provided by the middle and bottom horizontal panel support members 53, 54. In the embodiment shown, the trim panels 73 are identical in shape and hence readily interchangeable or replaceable. The panels 73 may be shaped to be installed in the same manner as the top trim panels.

Figure 15:
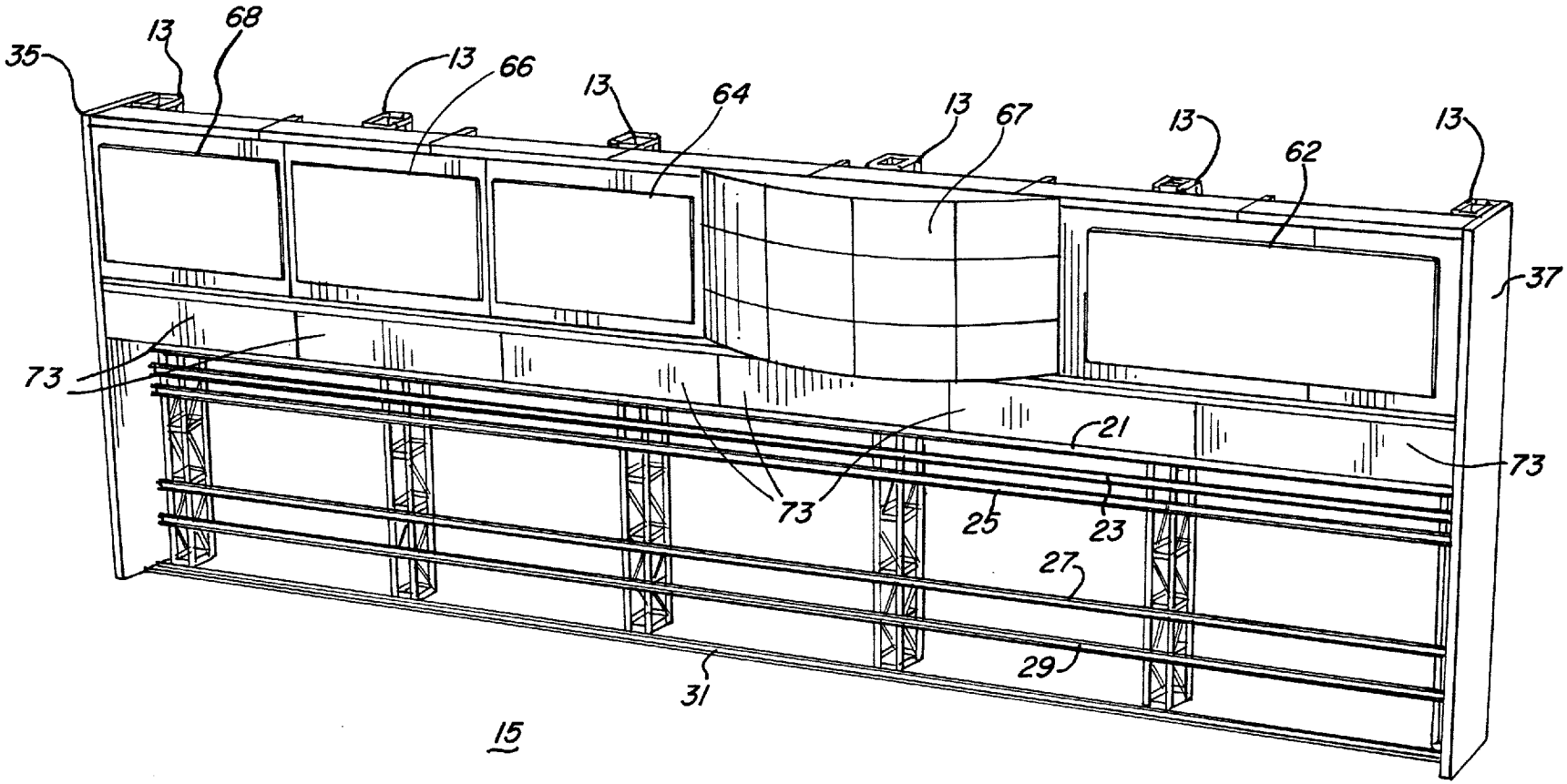
FIG. 15 is a perspective views illustrating an embodiment wherein peripheral frame members are attached to the top trim panels.
Figure 16:
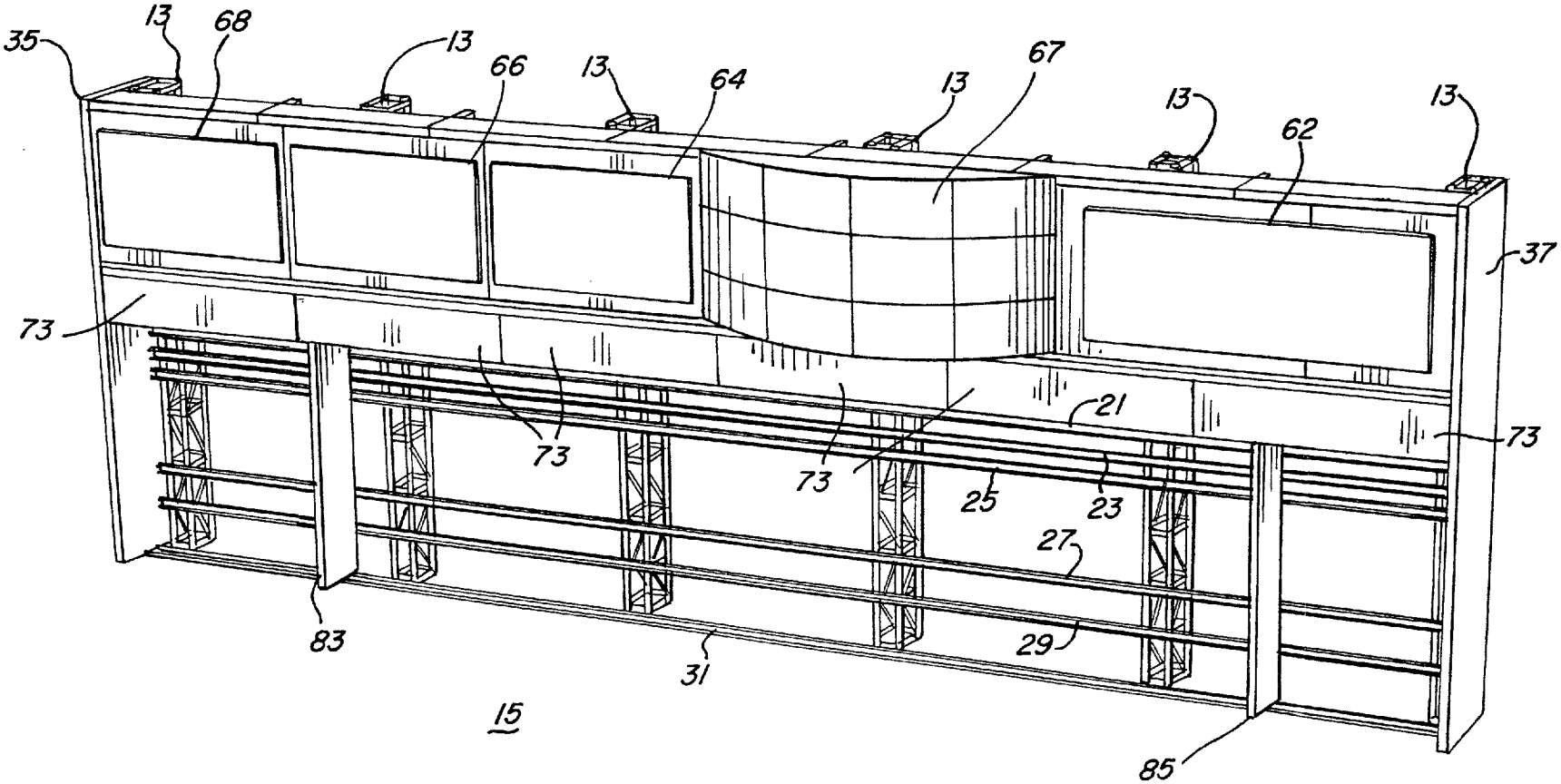
FIGS. 16-19 are perspective views illustrating the installation of inner side panels and lower cabinets into the structure of FIG. 15.
Figure 17:
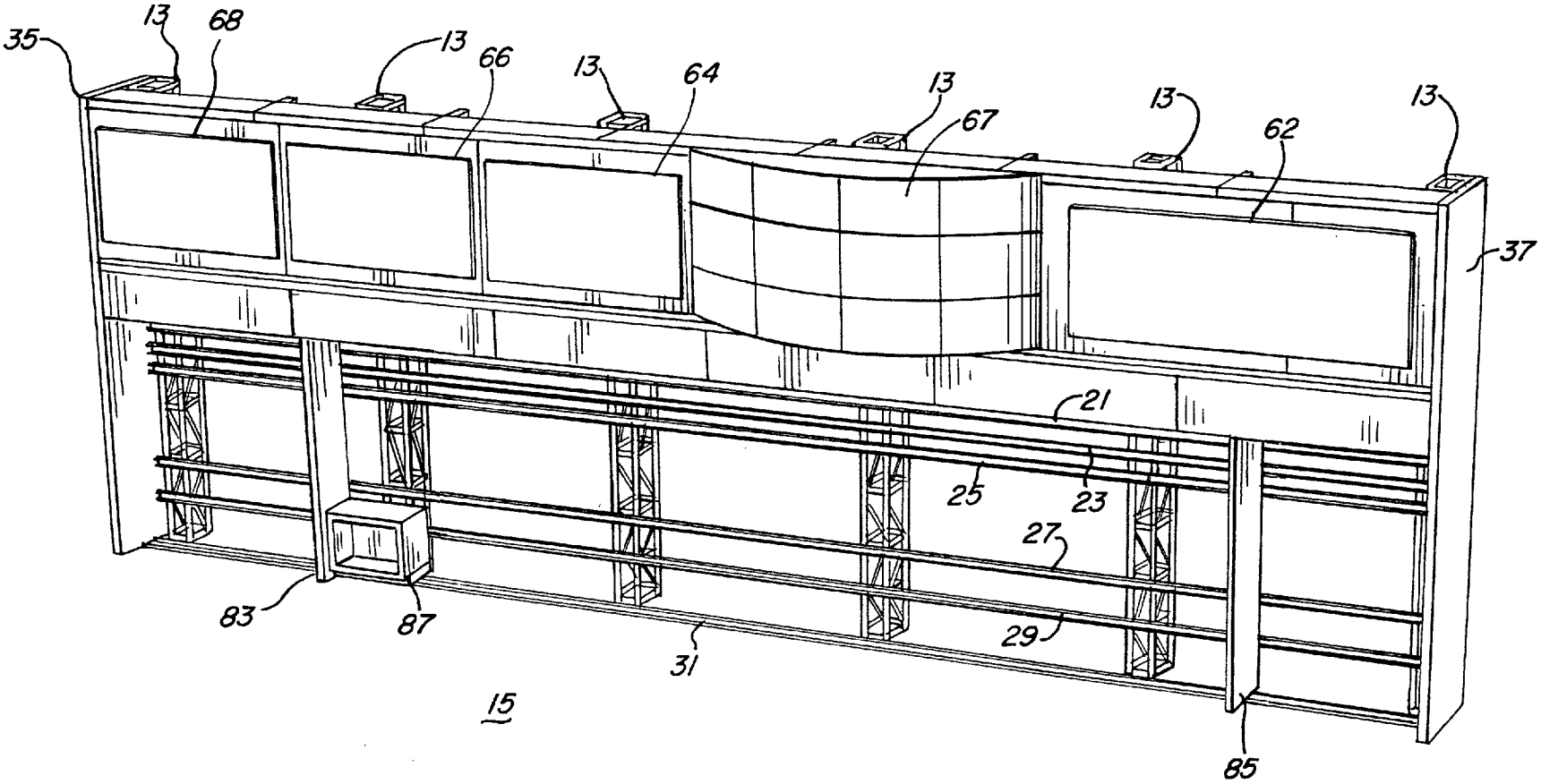
Figure 18:
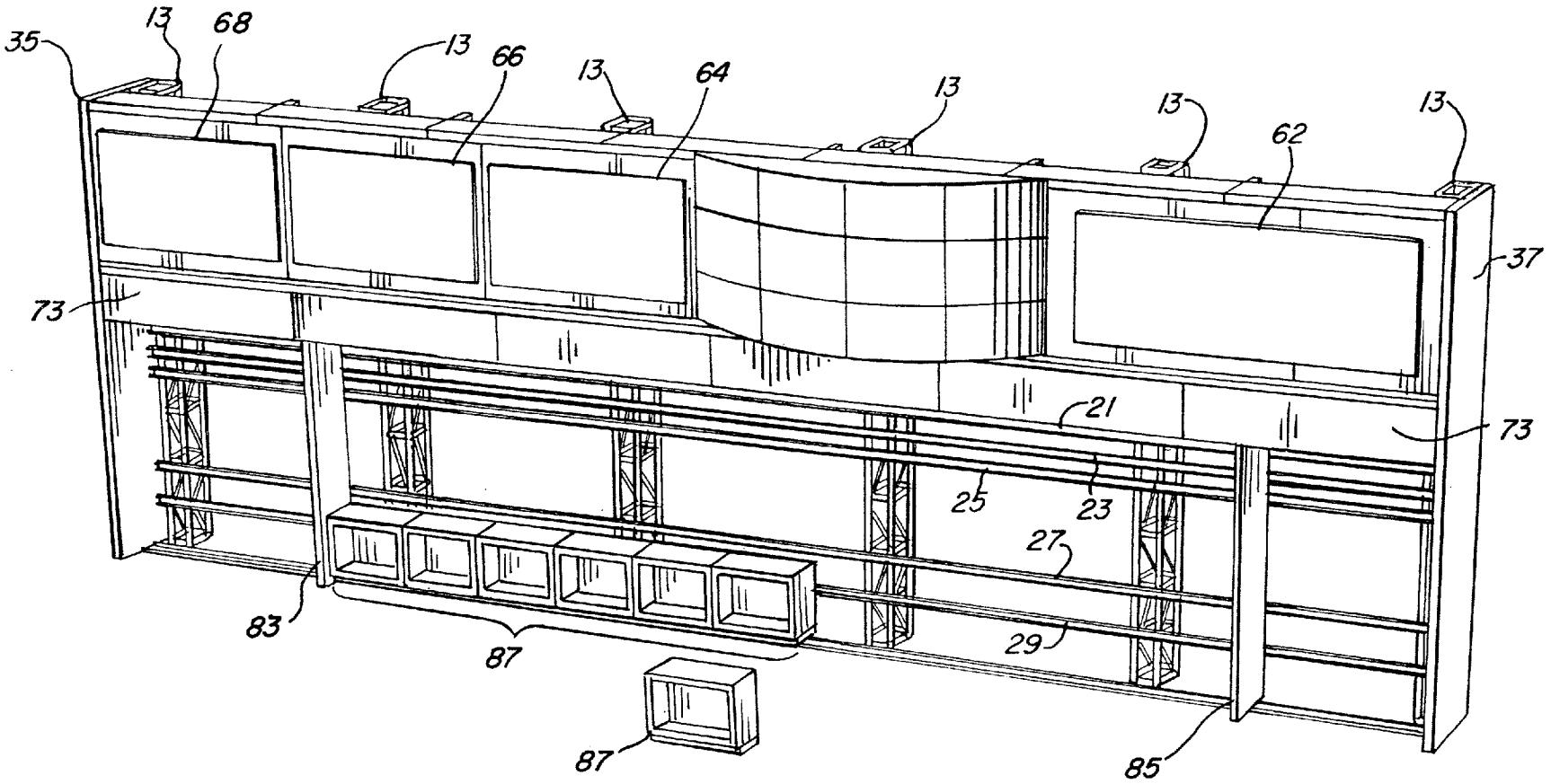
Figure 19:
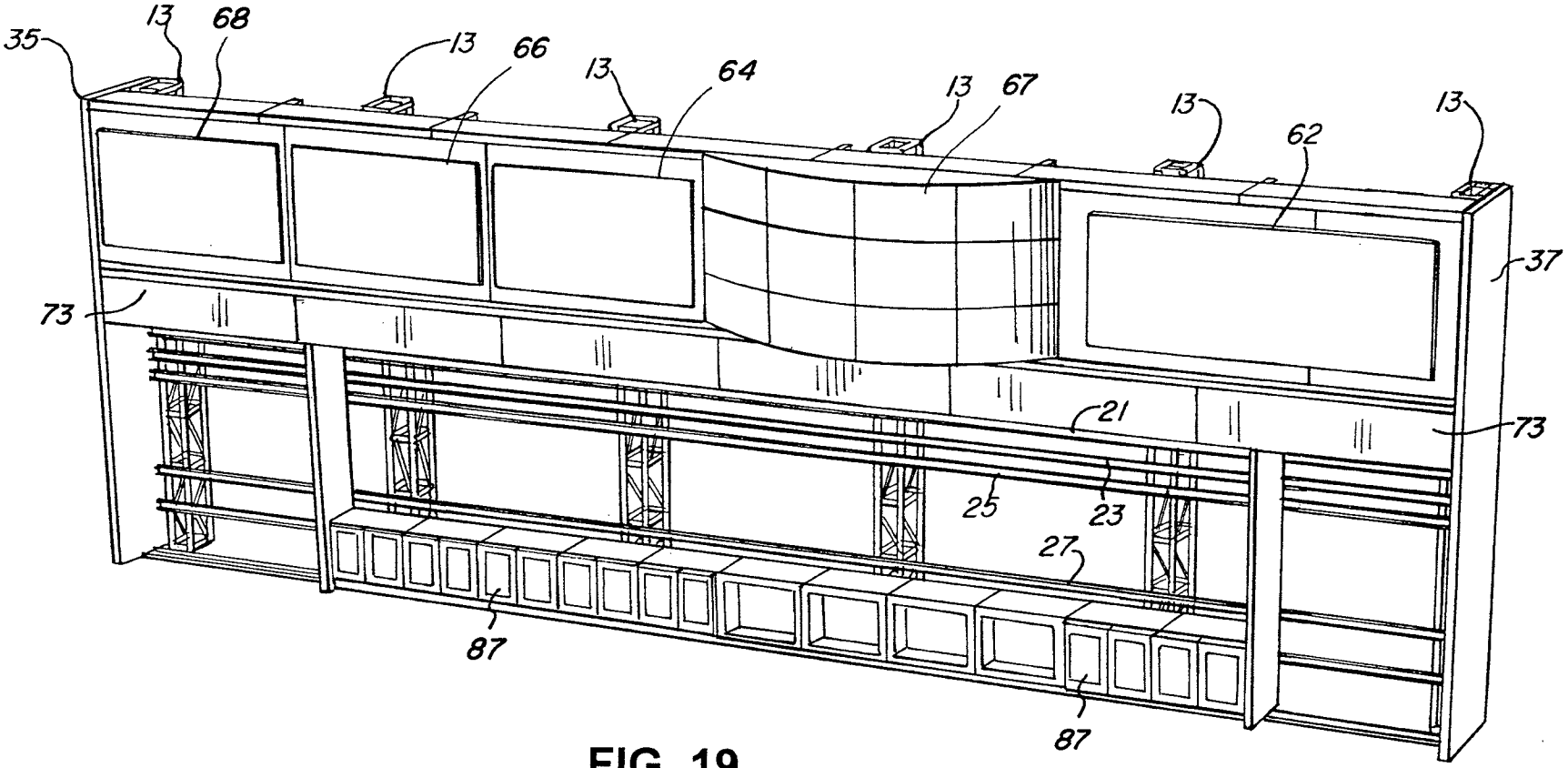

FIG. 15 illustrates an embodiment wherein border or frame members, e.g. 62, 64, 66, 68 are placed around the periphery of the display panels 61, 63, 65, 69, 71. Such members 62, 64, 66, 68 may comprise a shadow box or support surfaces for various graphic images and may be already attached to the panels 61, 63, 65, 69, 71 before those panels are inserted into the cantilever frames.

FIGS. 16-19 illustrate the addition of inner vertical disposed side panels 83, 85 and subsequent addition of a number of lower cabinets 87 between the panels 83, 85. The side panels 83, 85 are anchored to the five horizontal bars 21, 23, 25, 27, 29 and hook on or otherwise anchored to the horizontal floor track 31. In one embodiment, the same anchor mechanism may be used for connecting to the horizontal bars and floor track.

The cabinets 87 may be bolted or otherwise fastened to the lower most horizontal bar 29 and hooked into the channel of the horizontal floor track 31. As with the upper trim panels 61-71 and 73, the cabinets 87 are readily replaceable without altering or disassembling any of the other structure of the display, for example, if damaged by a forklift. In one embodiment, the cabinets 87 may be identically shaped units. The cabinets 87 may be various styles such as single drawer, double drawer, or no drawers at all. The side panels 83, 85 are also readily changed out without disassembly of any of the remaining structure.

Figure 20:
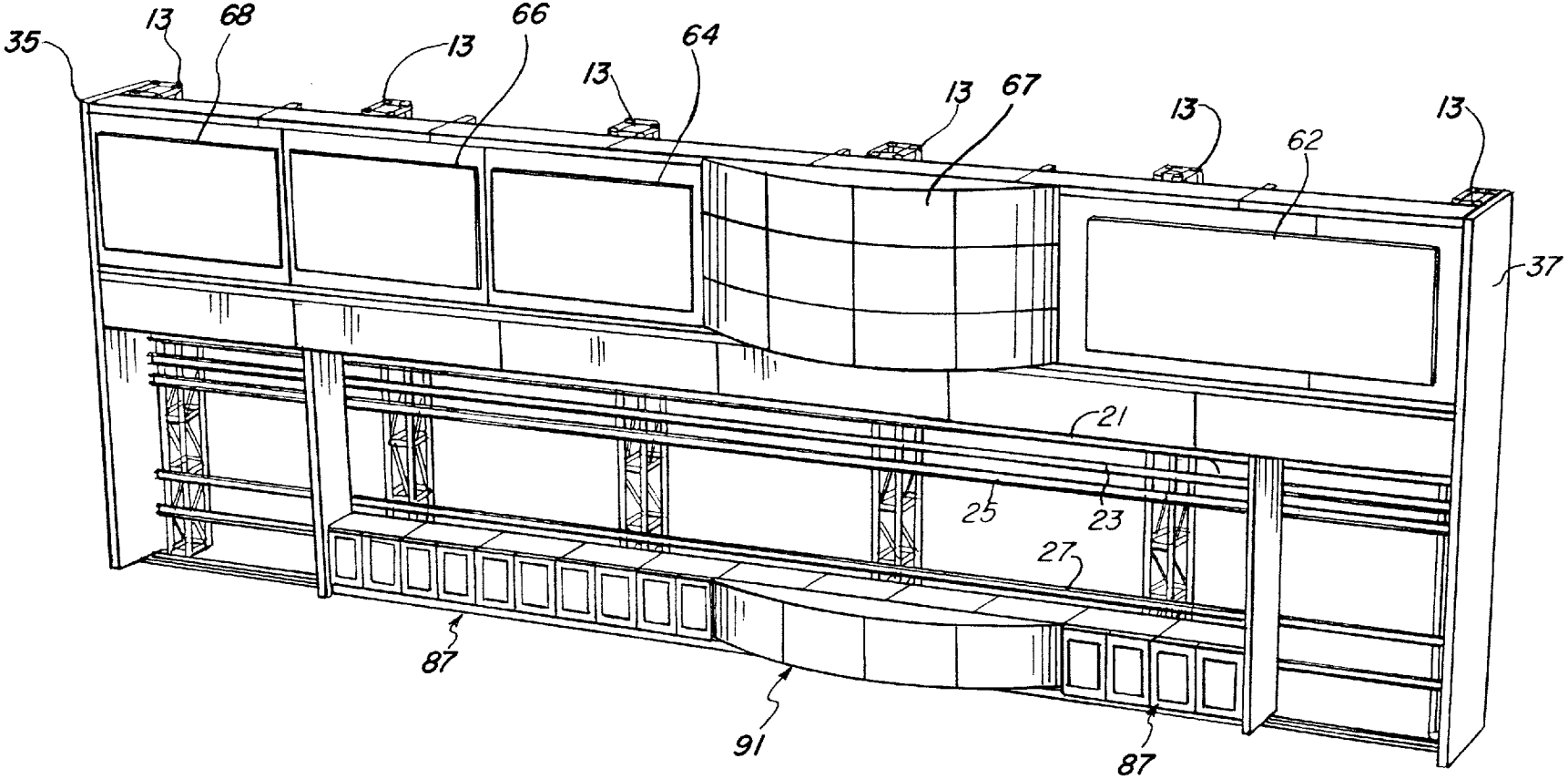
FIG. 20 is a perspective view illustrating addition of a lower "bump out" to the structure of FIG. 19.

FIG. 20 illustrates an embodiment wherein a lower "bump out" section 91 is added, which, in the illustrated embodiment, is of the same length and arc as the upper bump out 67 and vertically aligned with the upper bump out 67 for symmetry. The bump out 91 may attach to the floor track 31 and the horizontal rails, e.g. 27, 29, in the same manner as the cabinets 87. The bump out 91 may be omitted in some embodiments, such as that of FIG. 36.

Figure 21:
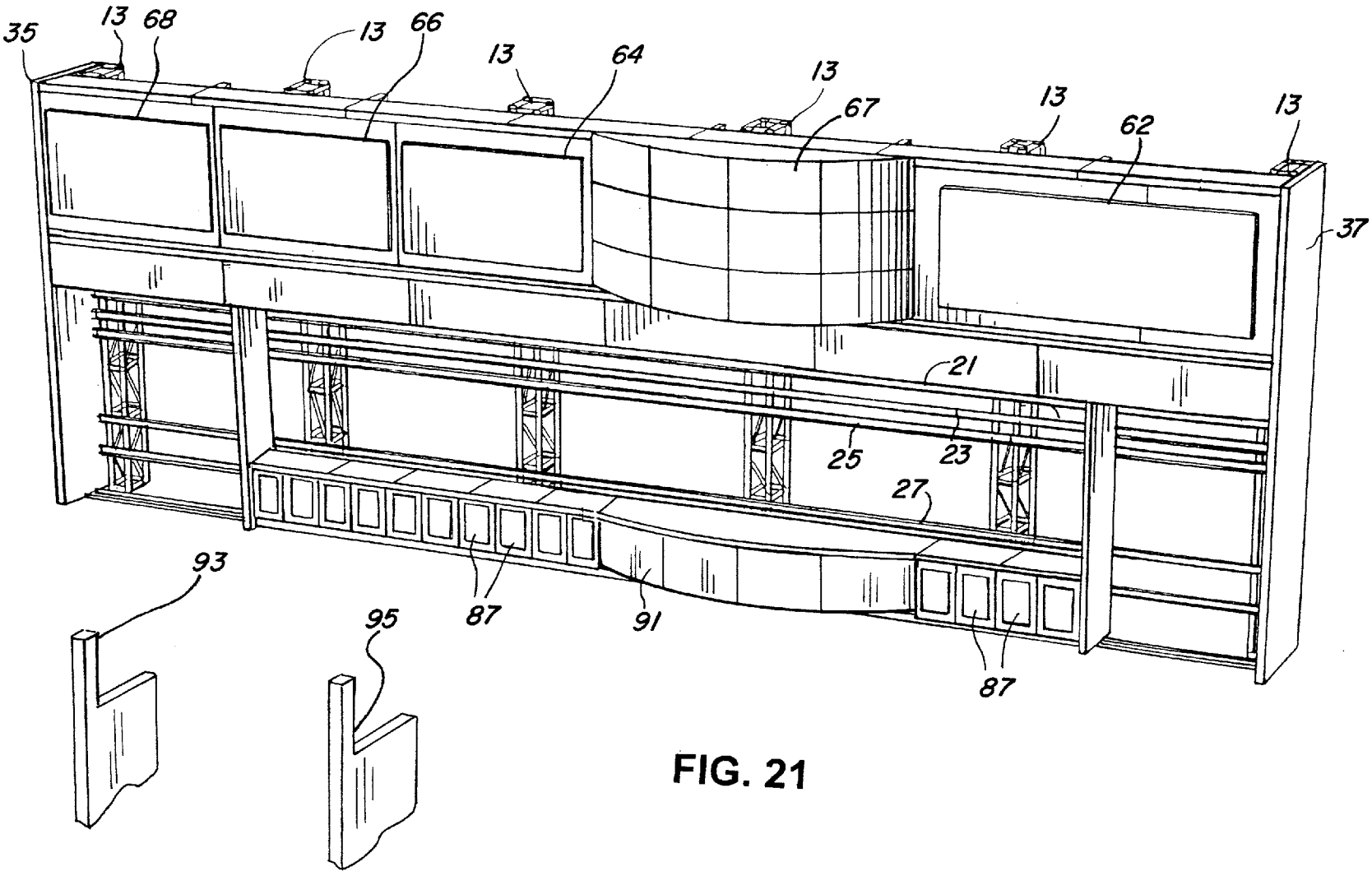
FIGS. 21-23 are perspective views illustrating addition of a kiosk unit to the structure of FIG. 20.
Figure 22:
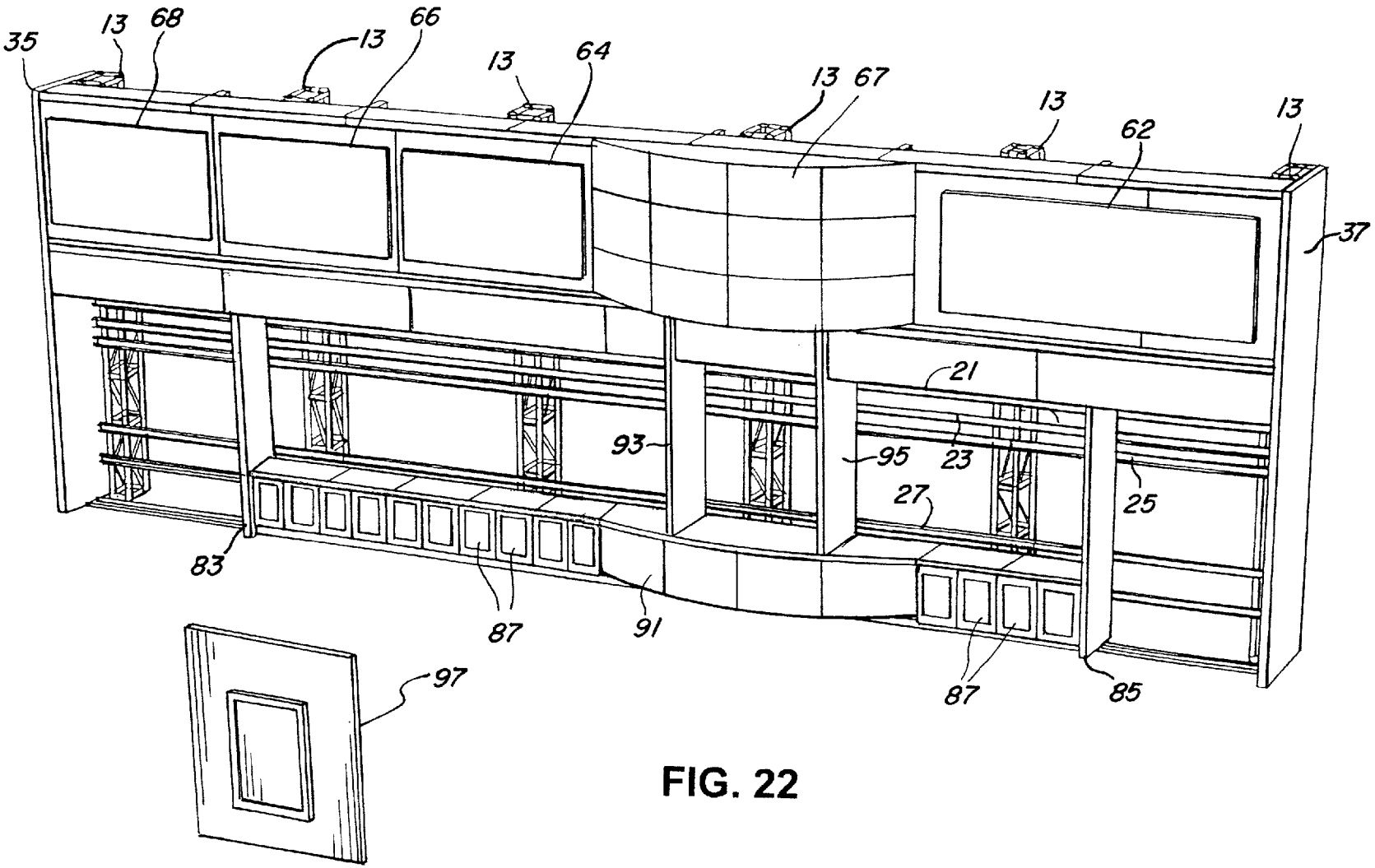
Figure 23:
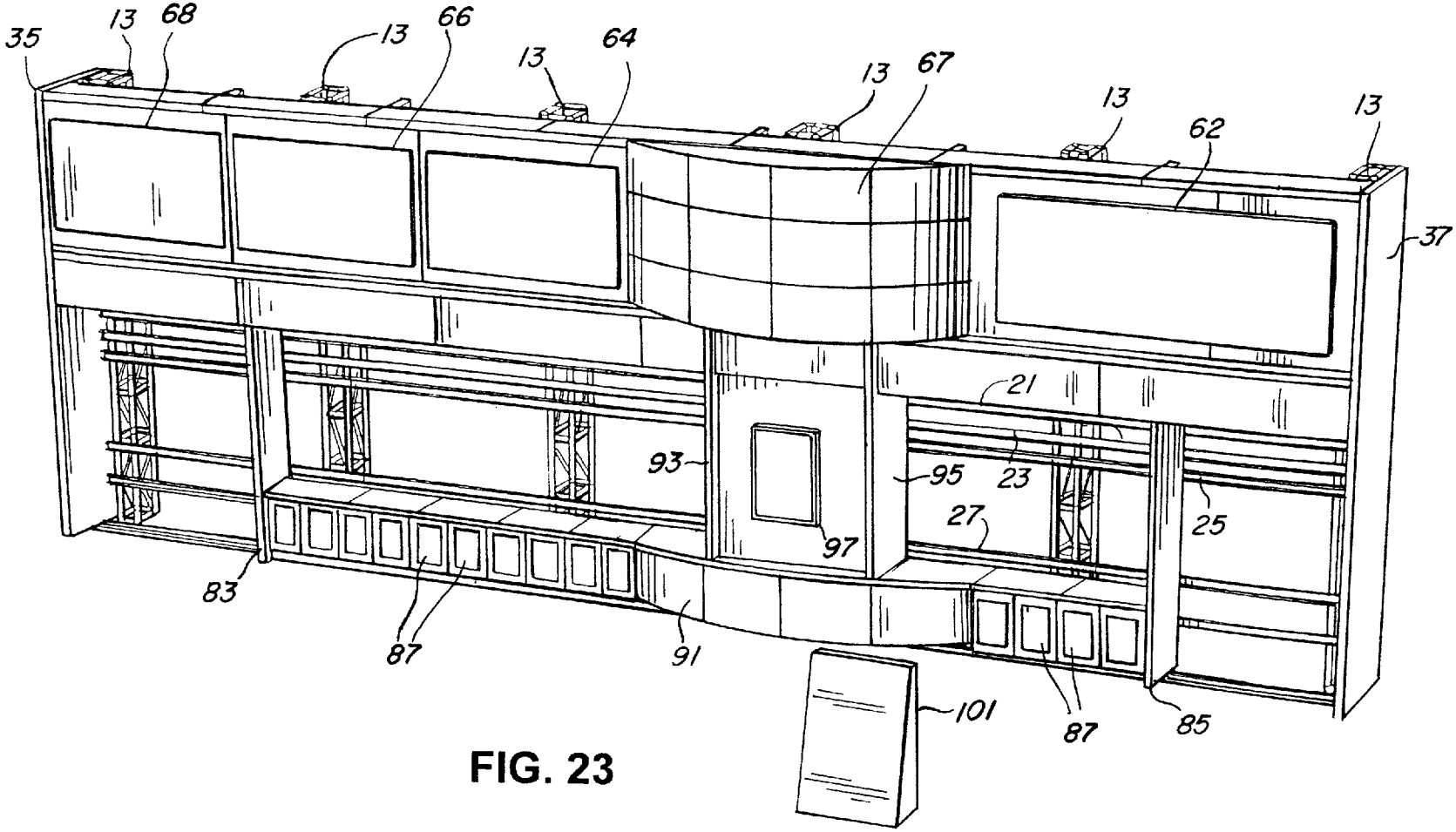
Figure 24:
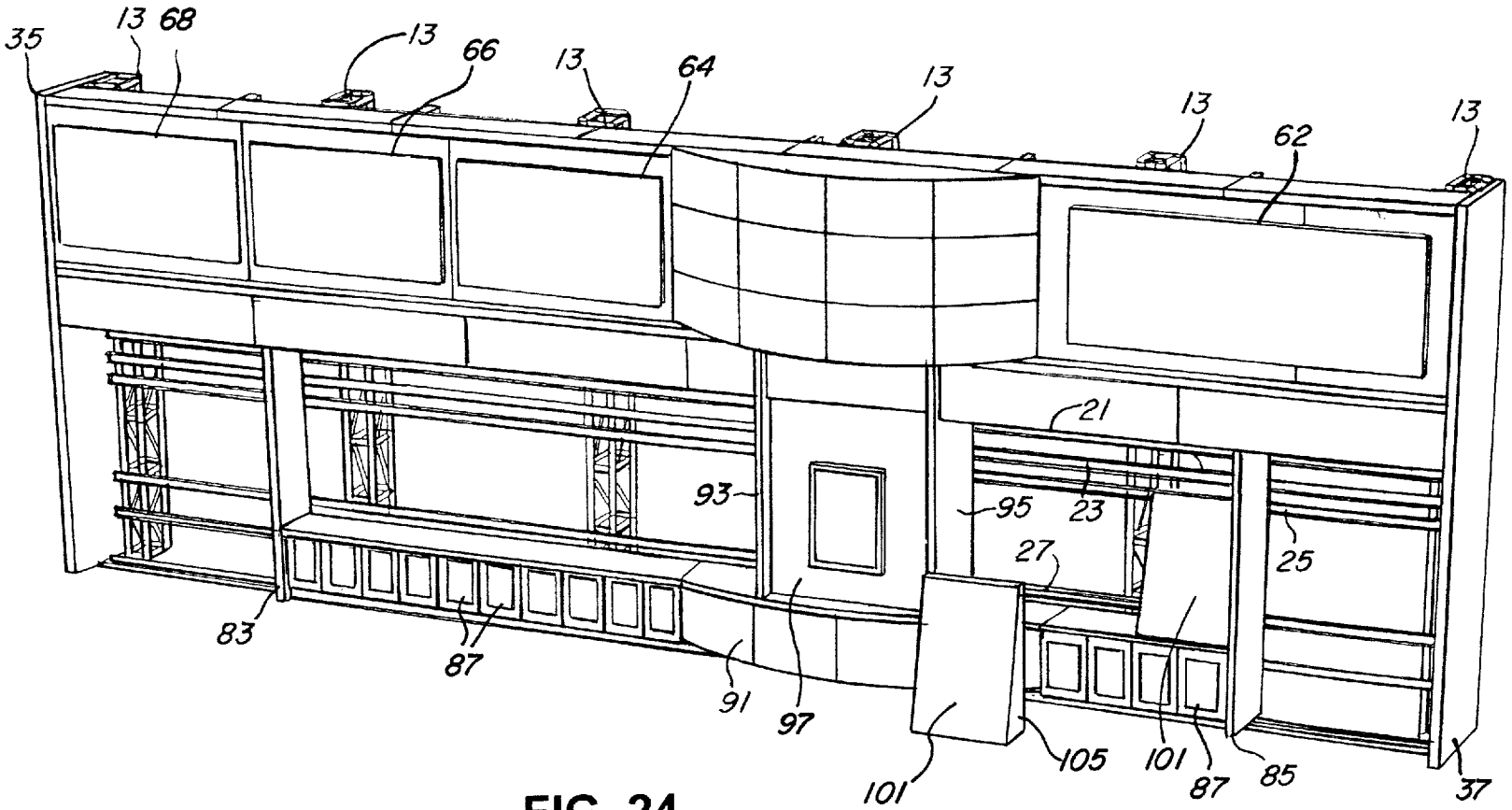
FIGS. 24-27 are perspective views illustrating addition of lower display support panels to the structure of FIG. 23.
Figure 25:
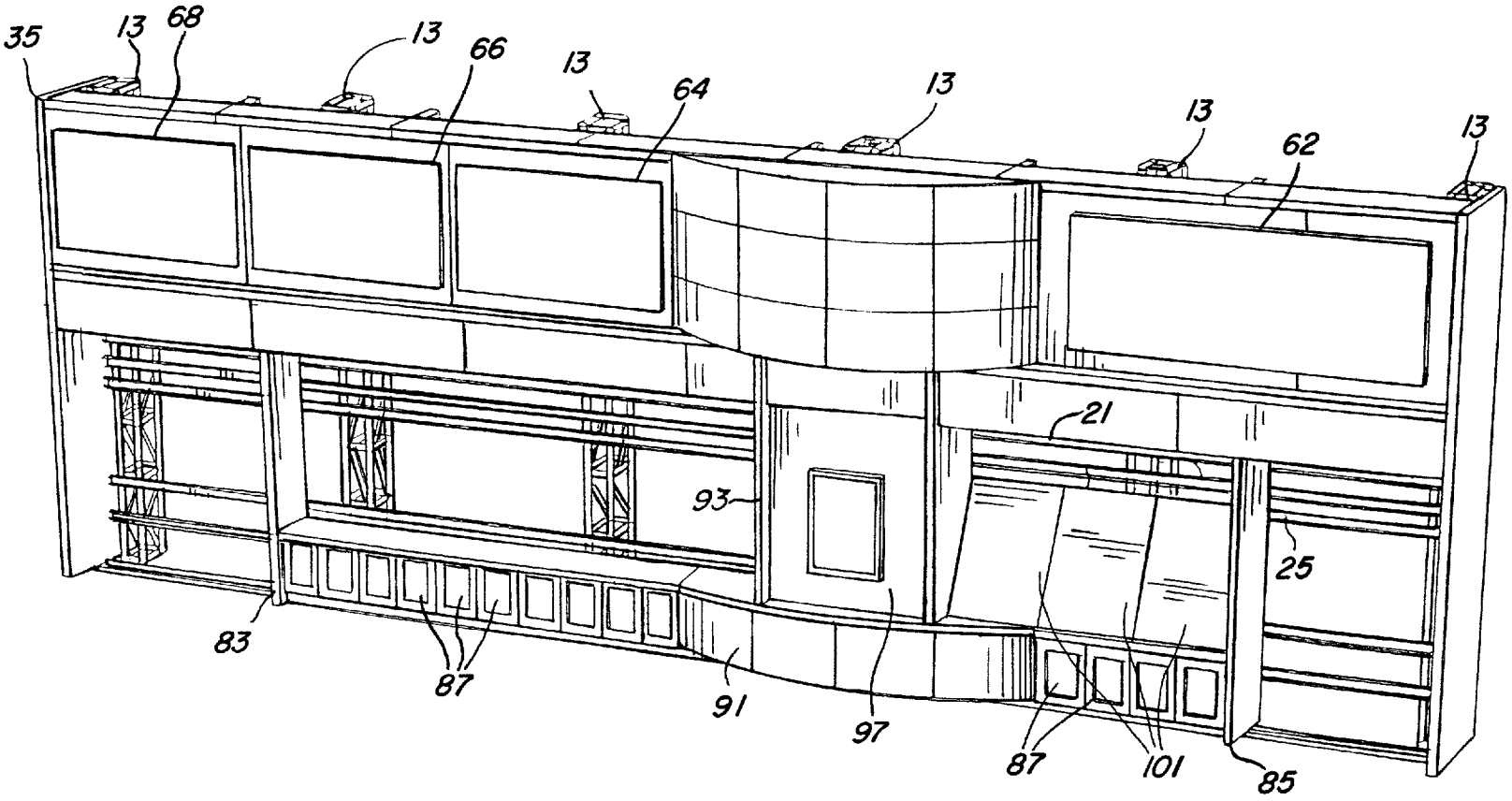
Figure 26:
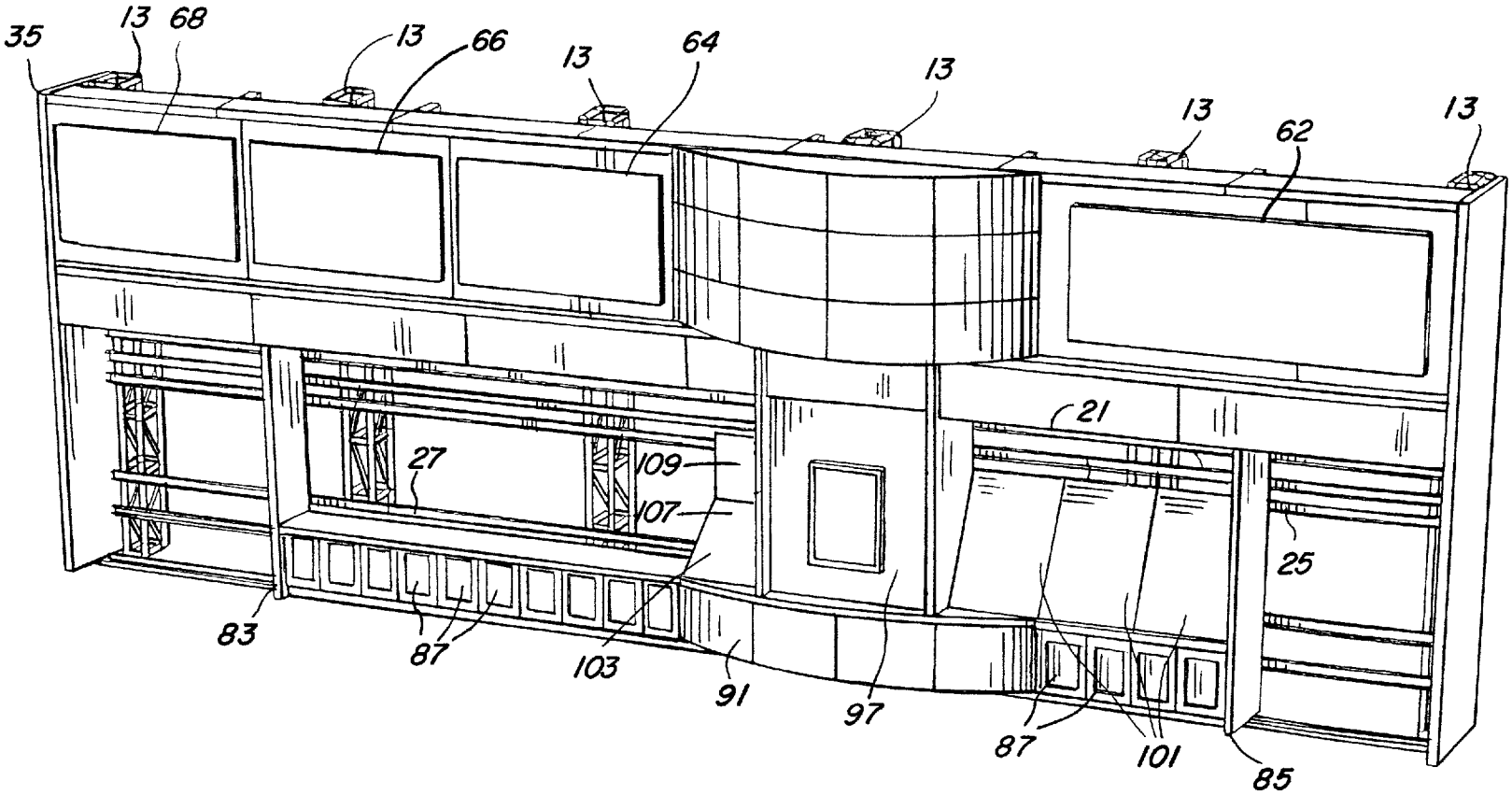
Figure 27:
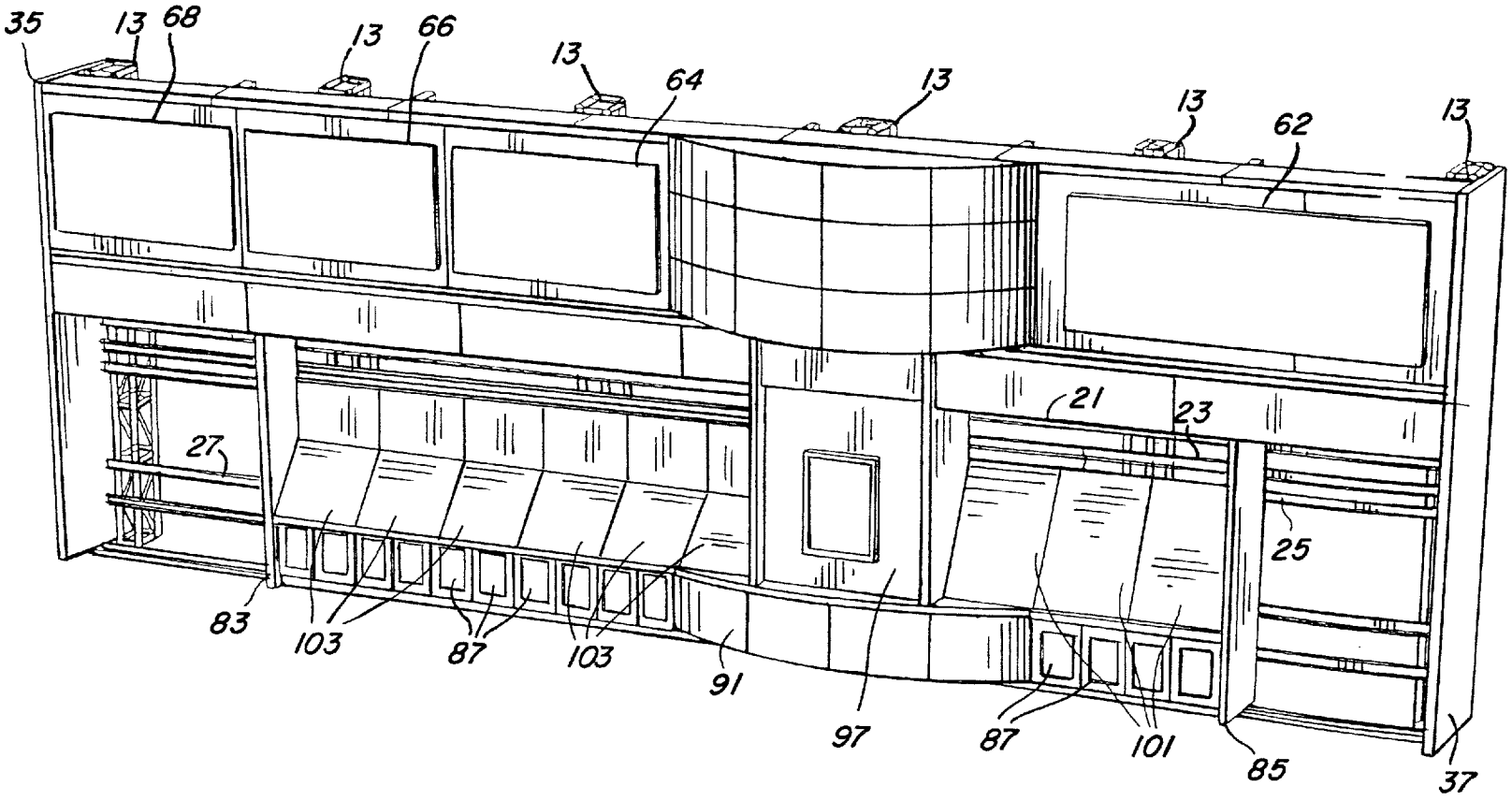
Figure 28:
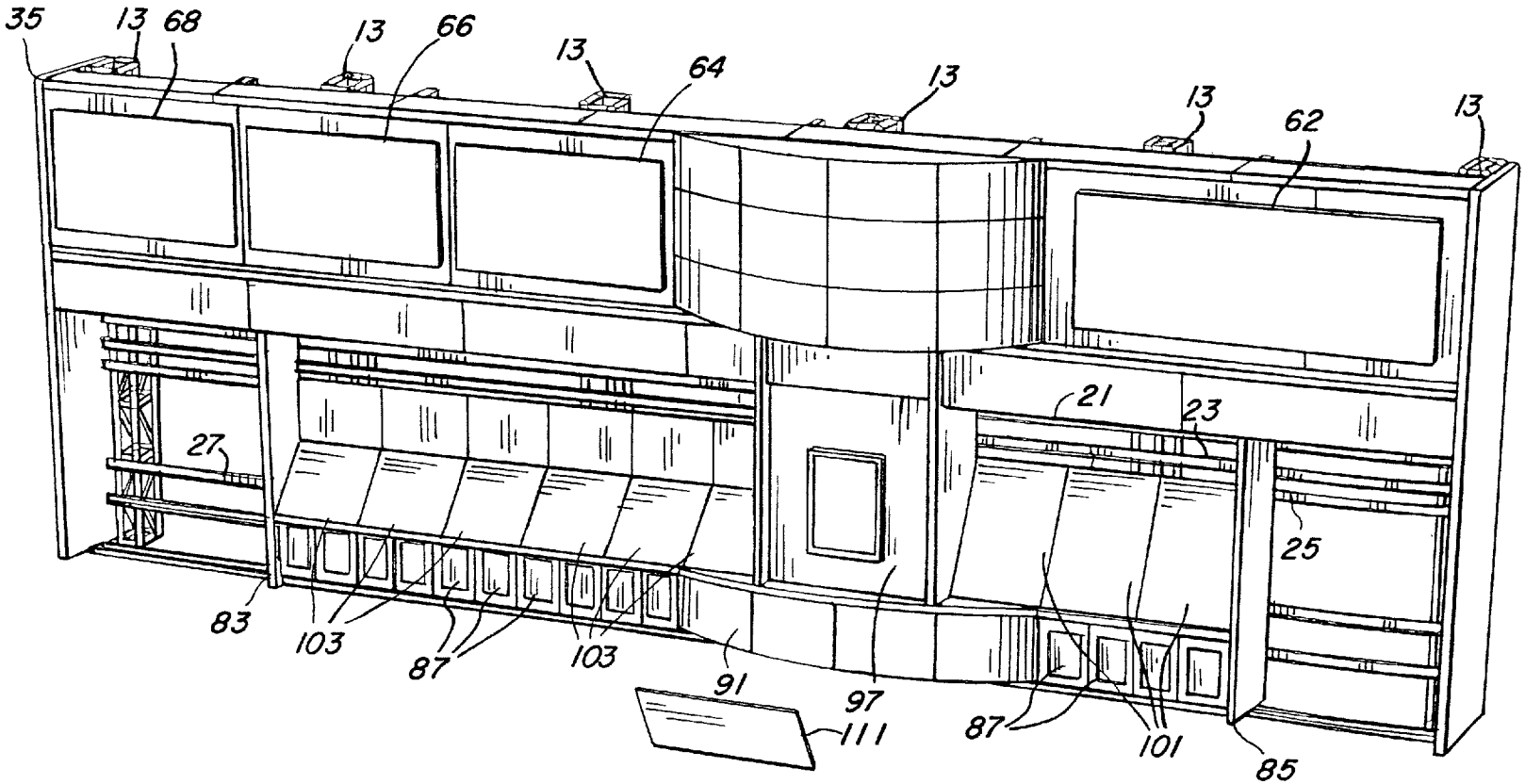
FIGS. 28-31 are perspective views illustrating installation of upper display panel support sections into the structure of FIG. 27.
Figure 29:
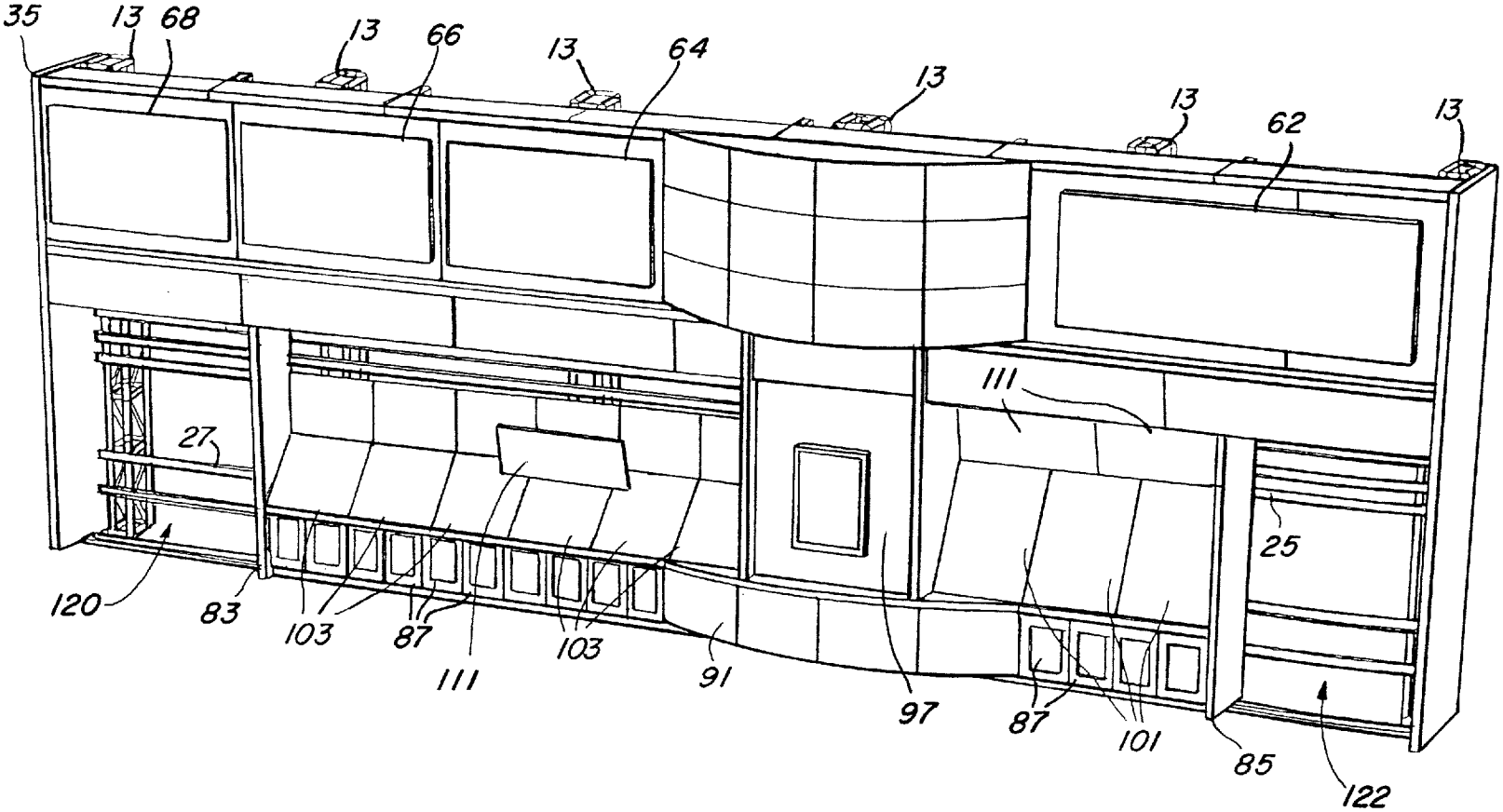
Figure 30:
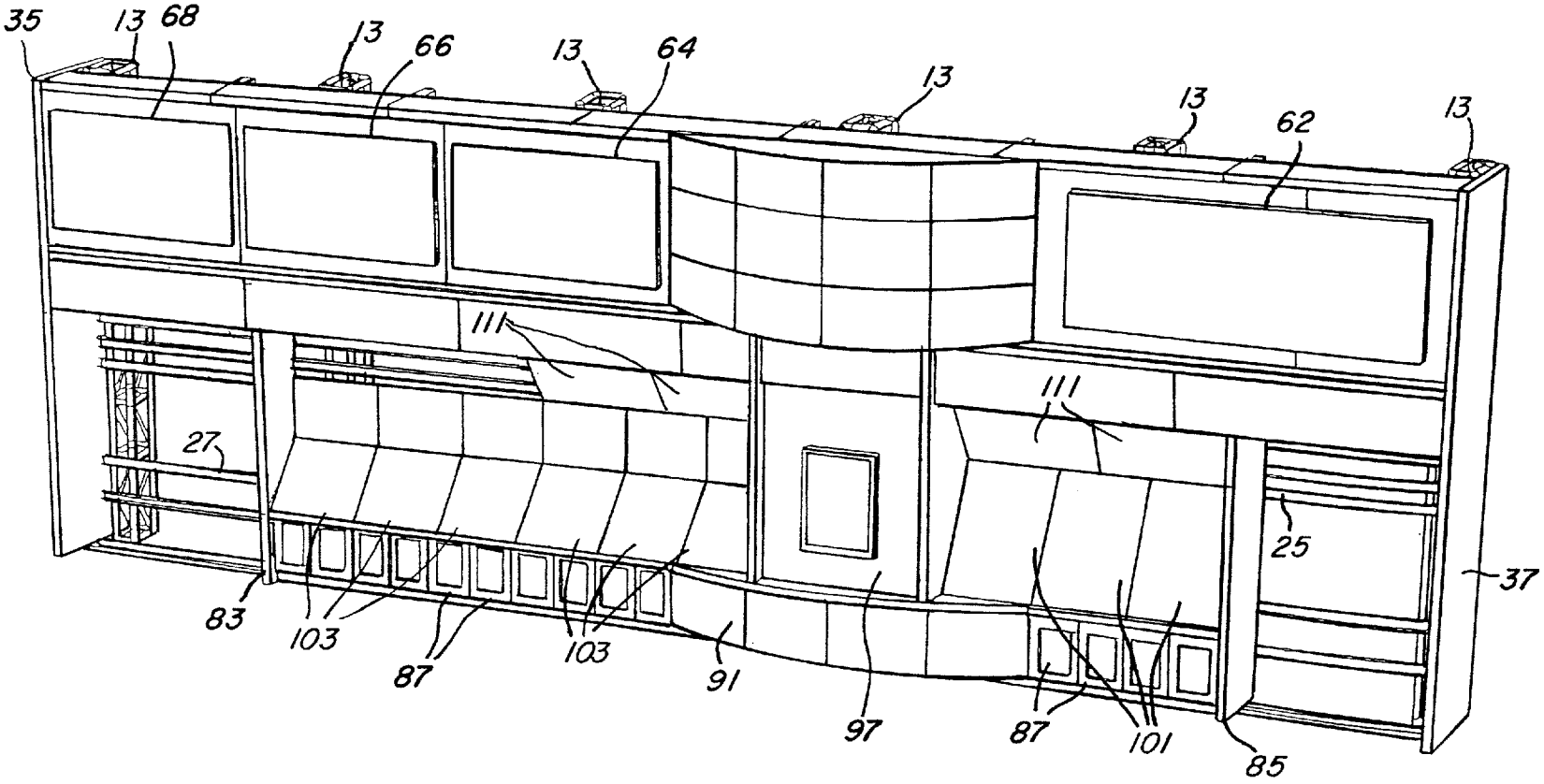
Figure 31:
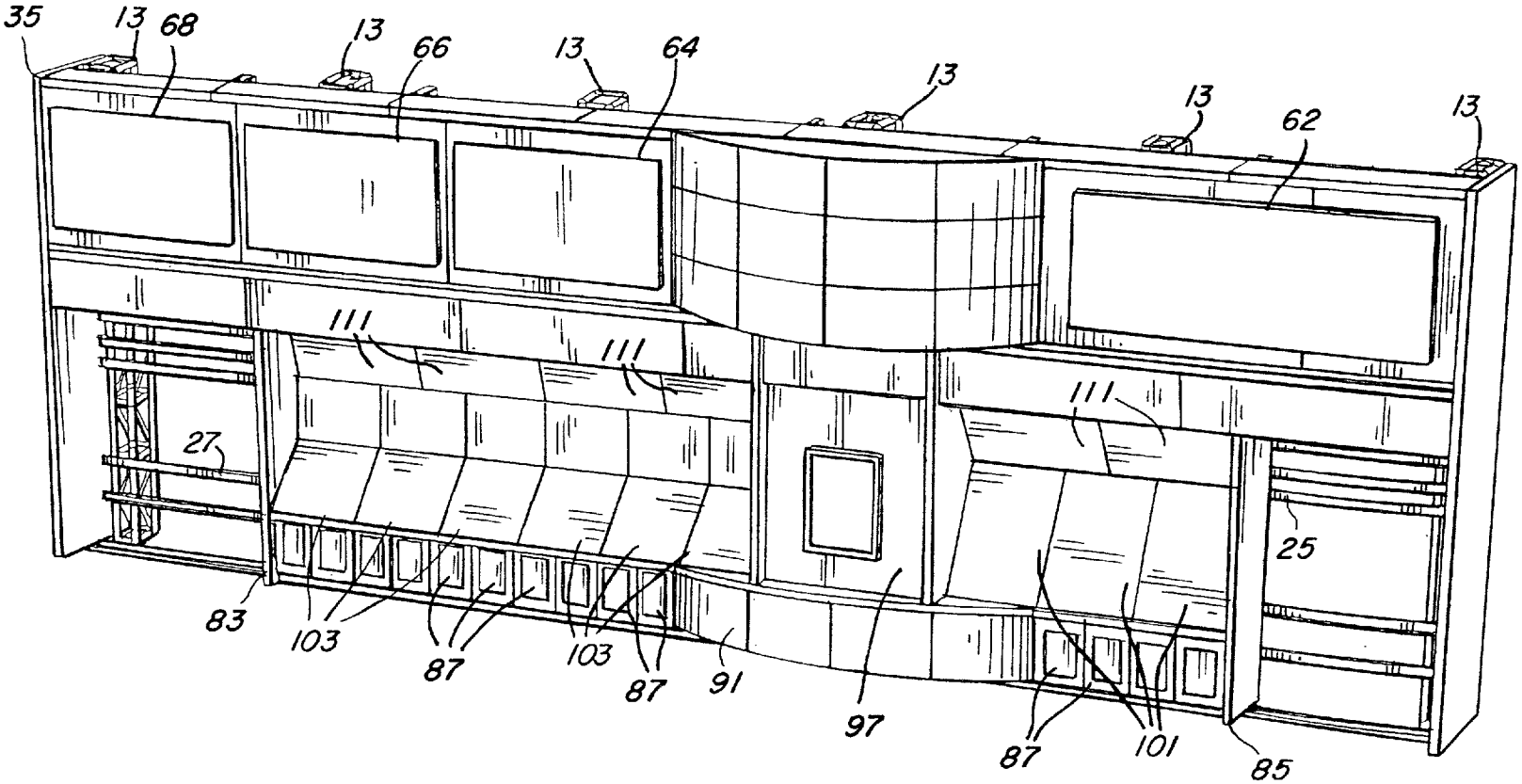

FIGS. 21-23 illustrate the addition of a kiosk display section comprising vertical side panels 93, 95 and a front panel 97. The vertical panels 93, 95 may be anchored to the horizontal bars 23, 25, 27, while the front panel 97 is attached between the side panels 93, 95 by suitable fastening devices. In another embodiment, the kiosk may be an enclosed unit or "locker" anchored to the back horizontal rails.

FIGS. 23-27 illustrate the installation of first and second groups of lower display support panels 101, 103 on top of the cabinets 87 and between the four inner side panels 83, 85, 93, 95. These panels 101, 103 may be anchored to two of the horizontal bars 25, 27. As shown, the three display support panels of the first group 101 have a right triangular side surface 105, and in an illustrative embodiment are identical in shape. Each of the second group of support panels 103 provides an angled rectangular lower front surface 107 and a vertical rectangular upper surface 109. In one embodiment, each support panel 103 is also identical in shape and is interchangeable and readily replaceable.

In one embodiment, the width and height of lower display panels 101, 103 may also be the same so that they are readily interchangeable, moveable and replaceable without alteration of the remaining structure. In other embodiments, various different shapes may be used to create a new or different visual appearance.

FIGS. 28-31 illustrate the installation of upper display panel sections 111, which angle outwardly from their bottom horizontal edges to their top horizontal edges. They may be attached to horizontal rails 21, 23 using the same kind of attachment mechanism.

Figure 32:
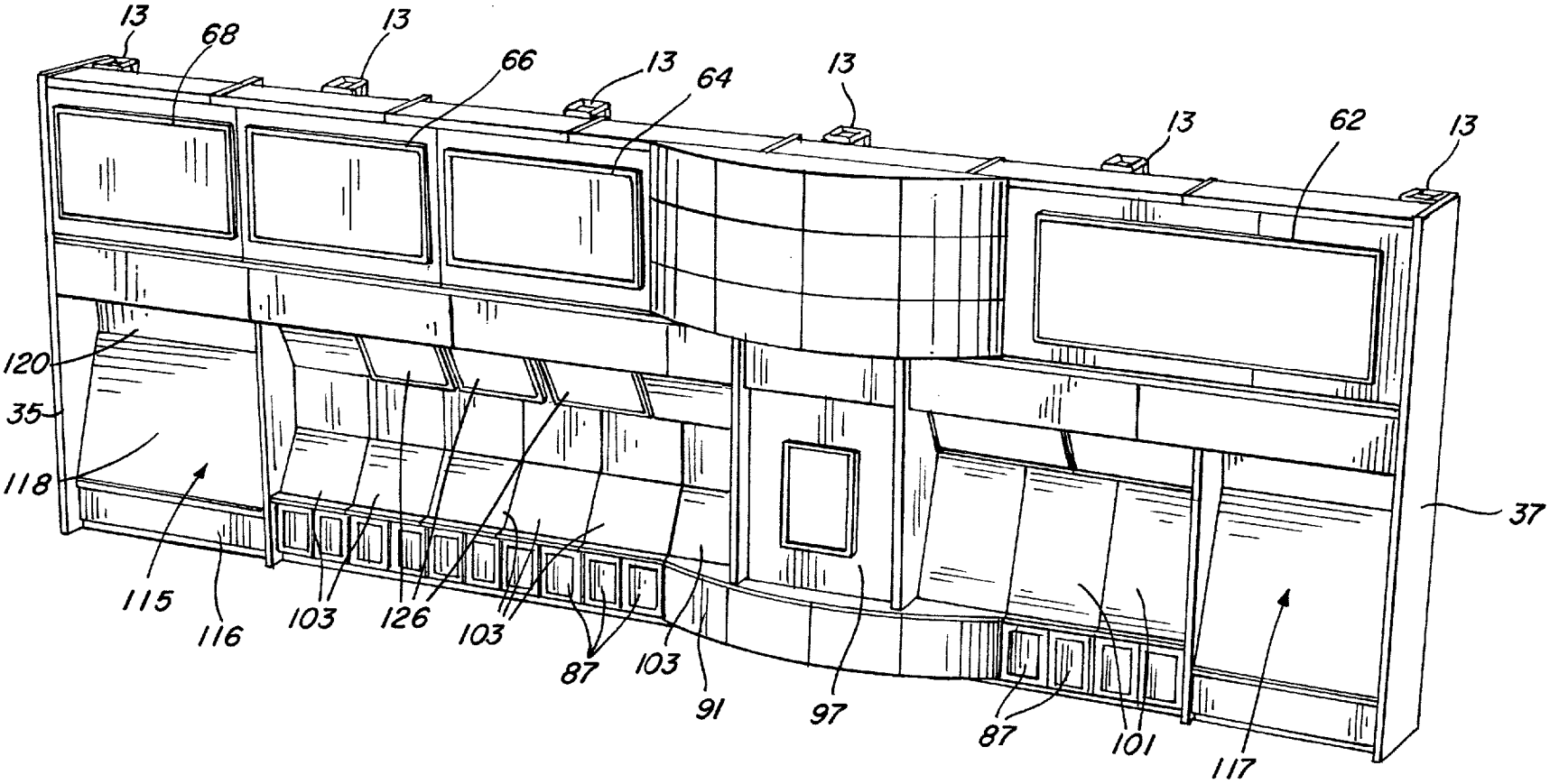
FIG. 32 is a perspective view illustrating addition of end display support structures to the structure of FIG. 31.

FIG. 32 illustrates end most display supports 115, 117, which comprise a lower, vertically disposed rectangular surface 116, a central angled rectangular surface 118, and a recessed upper vertically disposed rectangular surface 120, which may be suitably anchored to the track 31 and selected horizontal bars. Free standing display units could also be installed in the openings 120, 122 where the display supports 115, 117 reside.

Figure 33:
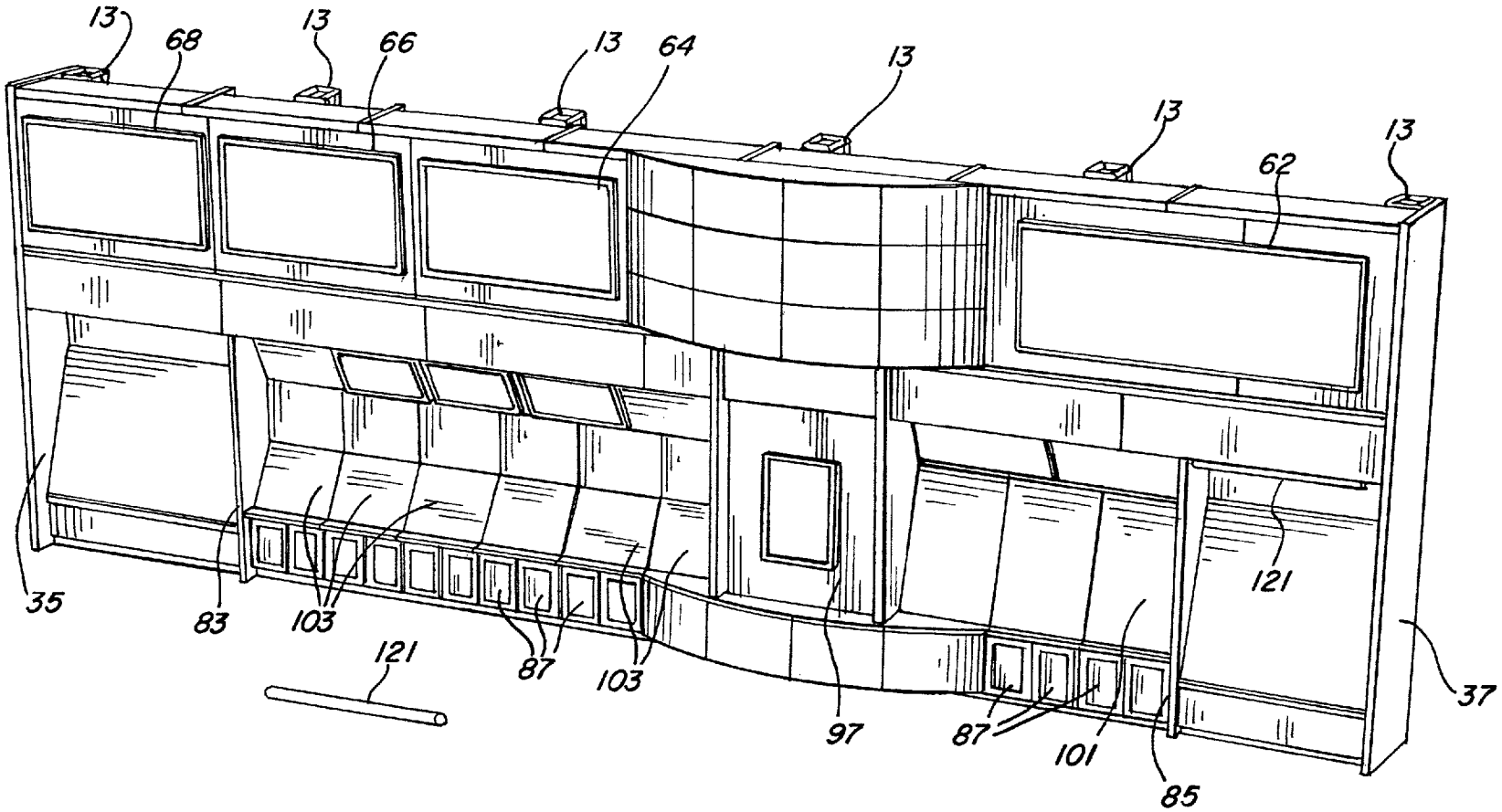
FIGS. 33-35 illustrate the addition of light fixtures to the structure of FIG. 32.
Figure 34:
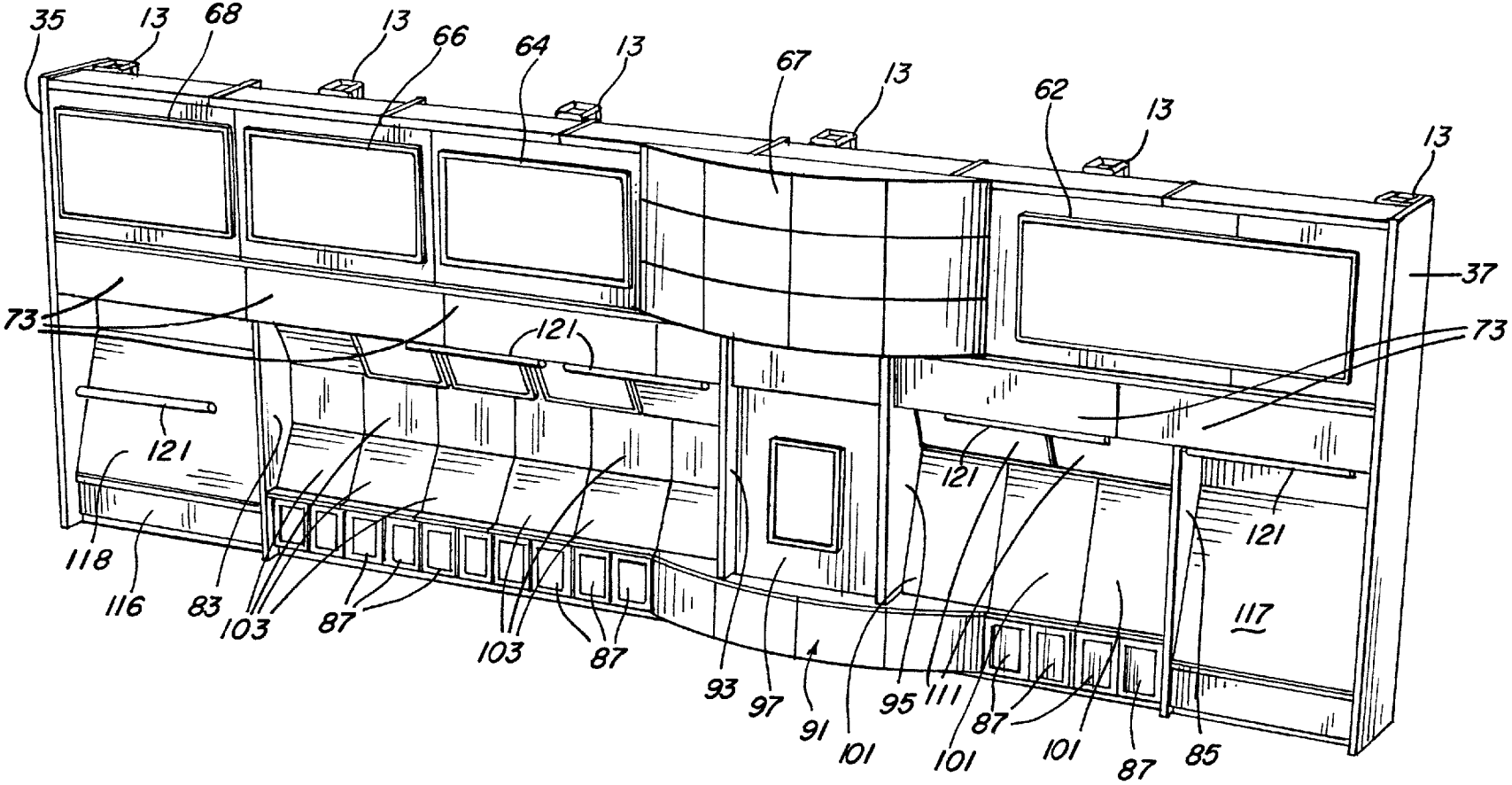
Figure 35:
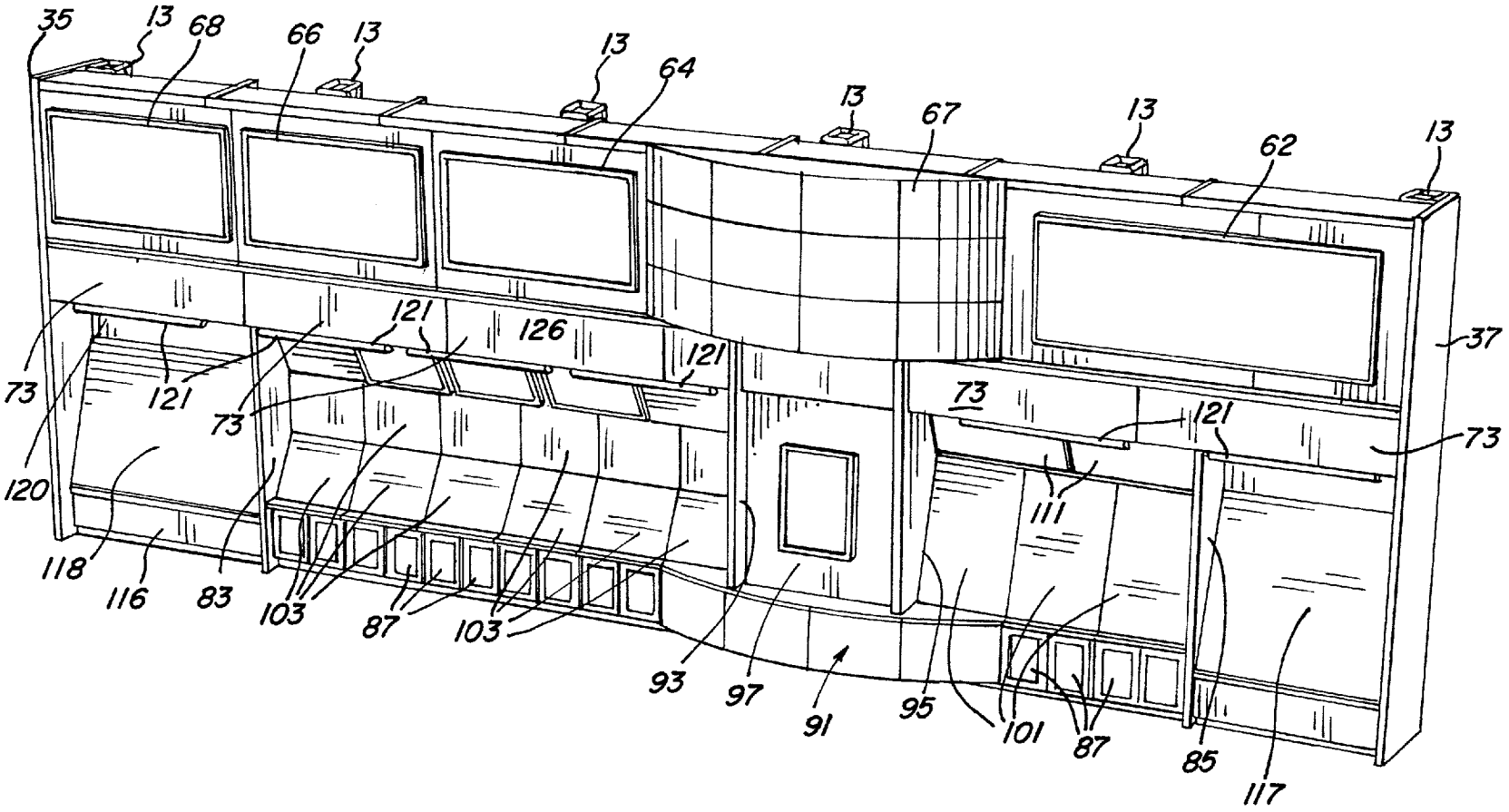
Figure 36:
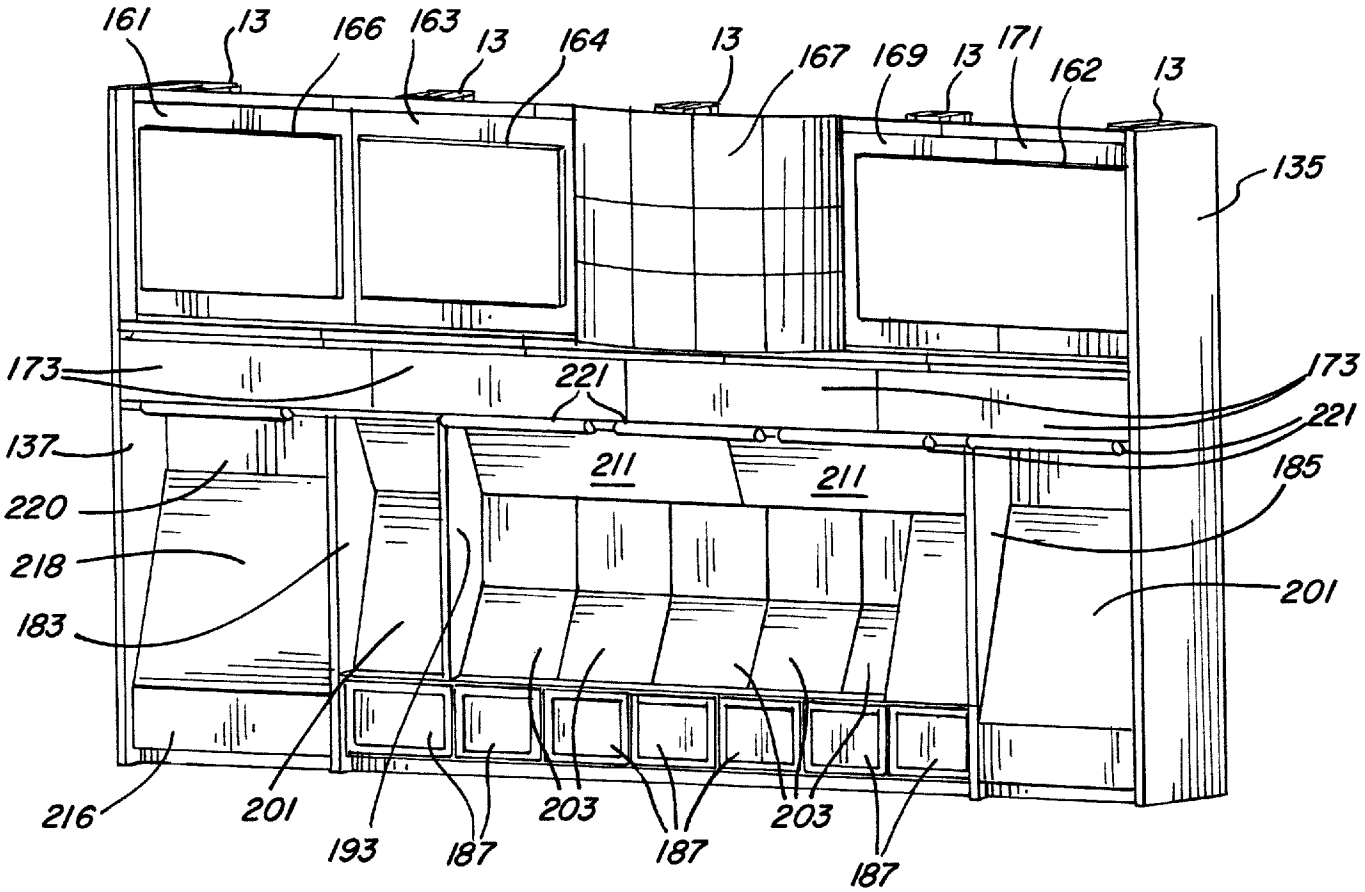
FIGS. 36 and 37 are front and rear perspective views, respectively, of an alternate display embodiment.
Figure 37:
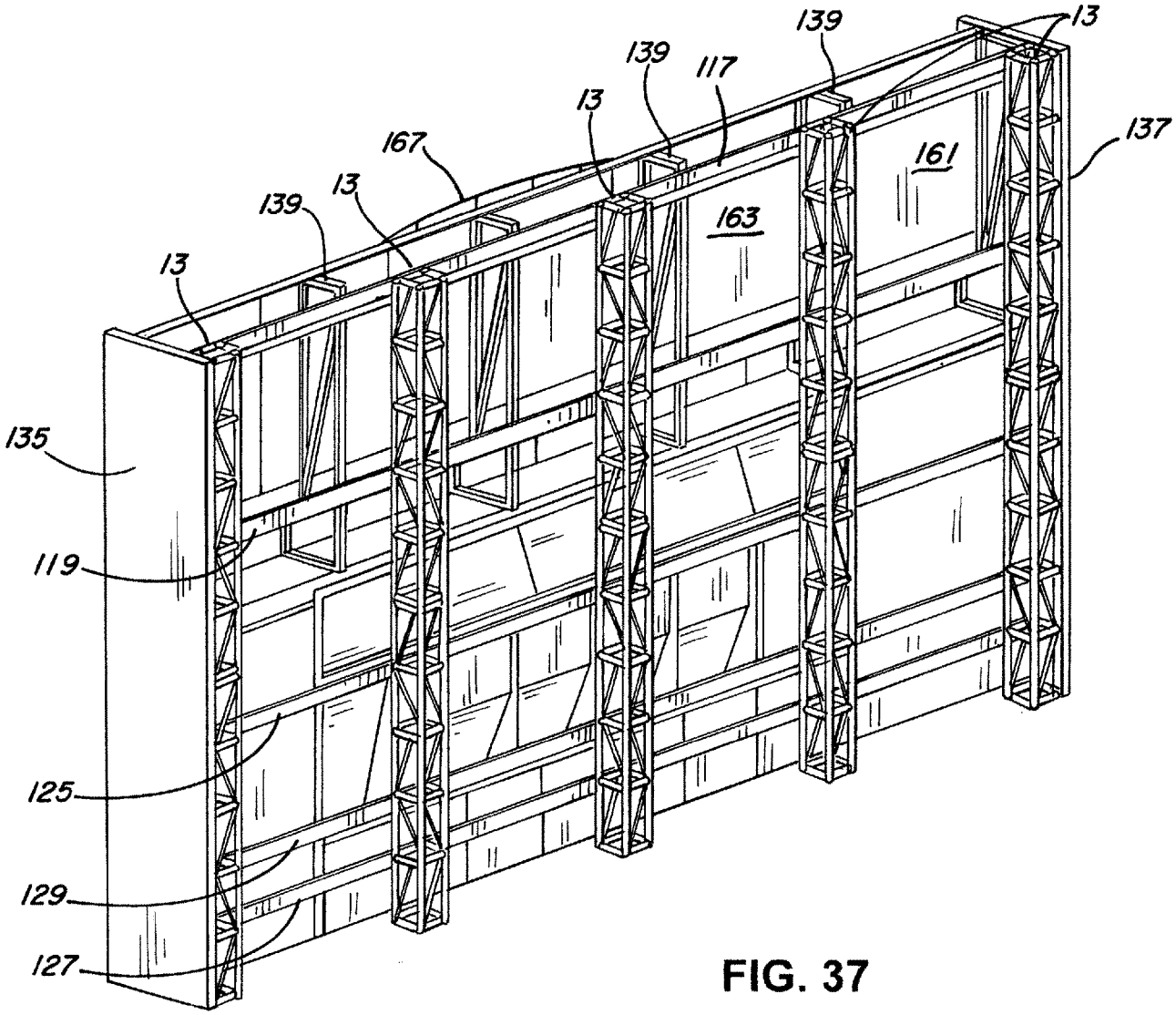

Finally, FIGS. 33-35 illustrate the installation of lighting fixtures 121 above the various display support surfaces. The fixtures 121 may be anchored to the panels 73 by bolts or other suitable fasteners and may be so attached prior to installation of the panels 73. FIG. 32 further illustrates three flat screen television units 126 mounted on respective panels 111, which may provide, for example, digital marketing functionality. Thus, panels 111 may be adapted to mount such TVs or other digital marketing devices. FIGS. 36 and 37 illustrate an alternate embodiment, which may be constructed according to the principles illustrated in FIGS. 1-35.

The alternate display of FIG. 36 includes upper trim panels, 161, 163, 169, 171, and a bump out panel, 167. Border or frame members 166, 164, 162 are disposed on the front surface of the trim panels 161, 163, 169, 171. Vertical end panels 135, 137 are attached at opposite ends of the display of FIG. 36. The display of FIG. 36 further includes intermediate trim panels 173 and lower cabinets 187. The side panels 183, 193, 185 are vertically disposed to define respective sections of the lower display area of the display of FIG. 36. The lower display area includes lower display support panels 201, 203, 218. The left most display area comprises a vertically disposed rectangular surface 116, centrally angled surface 118, and recessed vertically disposed rectangular surface 120. The vertically disposed truss support members 13 may also be seen in FIG. 36. Finally, lighting fixtures 221 are disposed above the lower display area.

The support structure for the display of FIG. 36 is shown in FIG. 37. This support structure is constructed in generally the same manner as that shown, for example, in FIGS. 2-7. This support structure includes vertical truss members 13, horizontal support members which may comprise metal rails or bars 125, 127, 129, 119, 117, and cantilever supports 139. Although not shown, a horizontal floor track, for example, floor track 31 of FIG. 3, may or may not be employed in the embodiment of FIG. 37.

Figure 38:
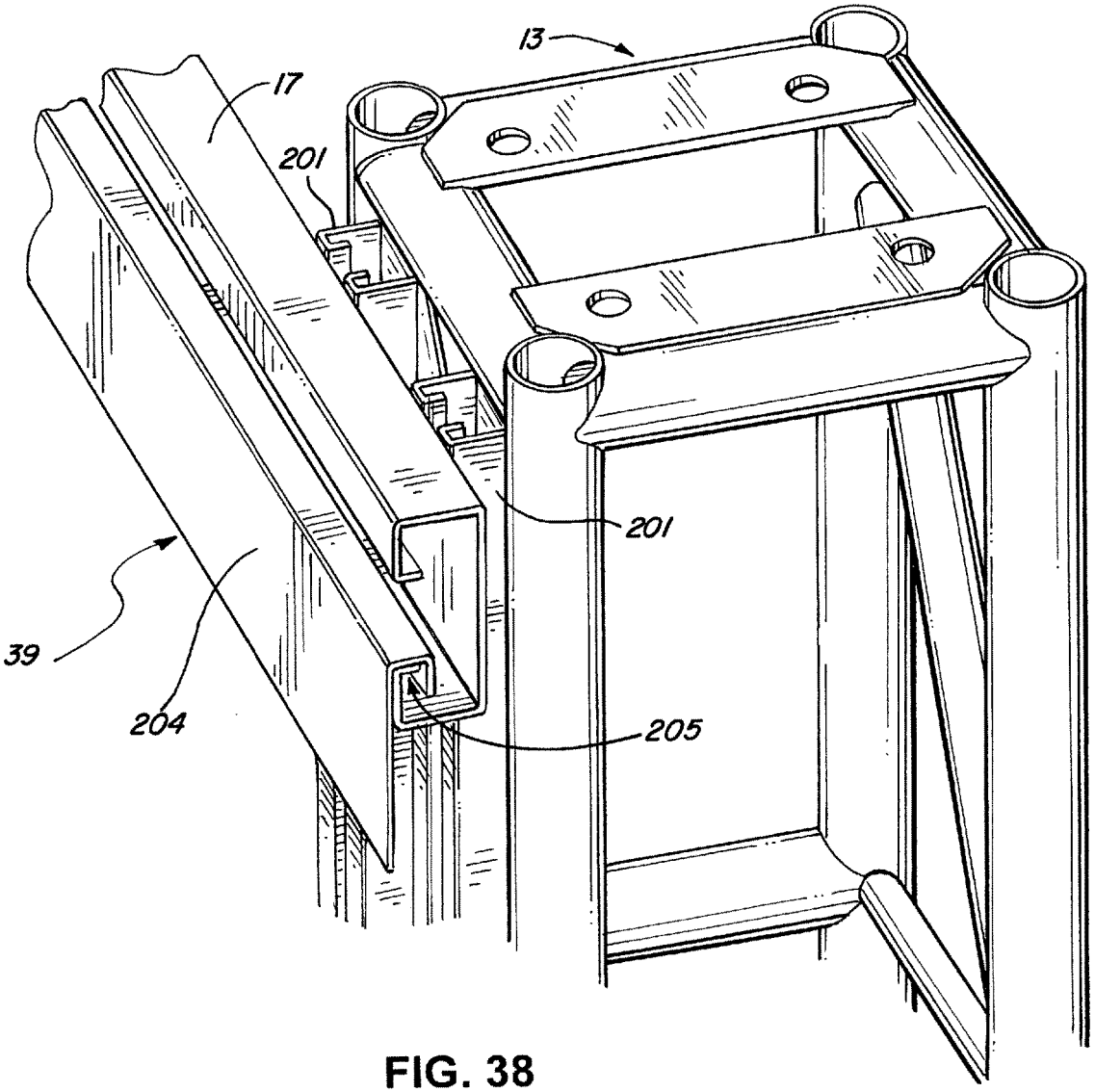
FIG. 38 is a fragmentary perspective view of structure for providing flexible positioning of display components according to an illustrative embodiment.
Figure 40:
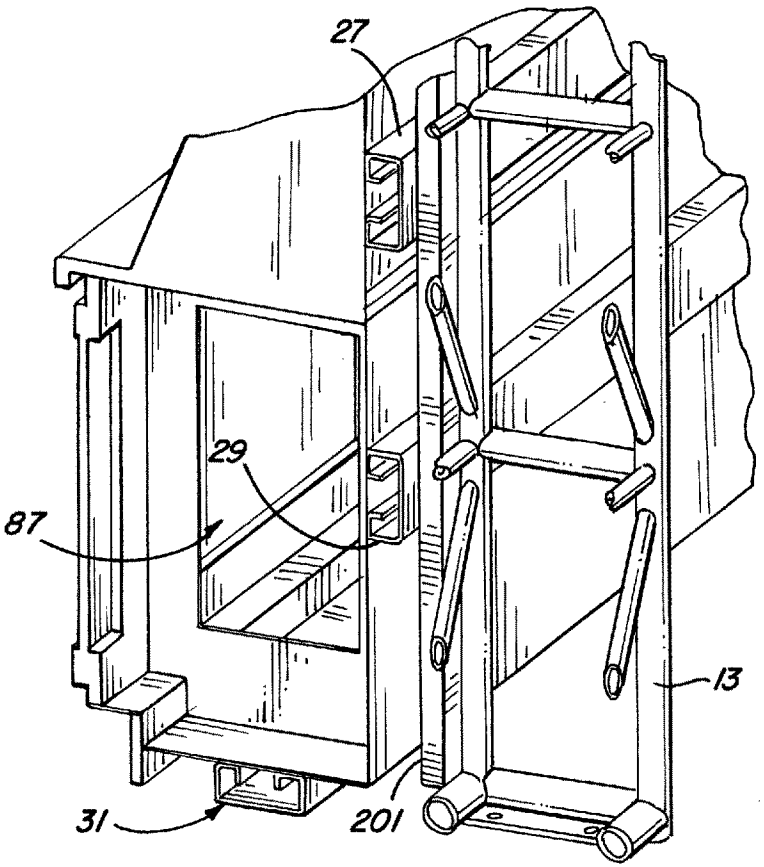
FIG. 40 is a fragmentary perspective view of structure for positioning and holding in place cabinets according to an illustrative embodiment.
Figure 39:
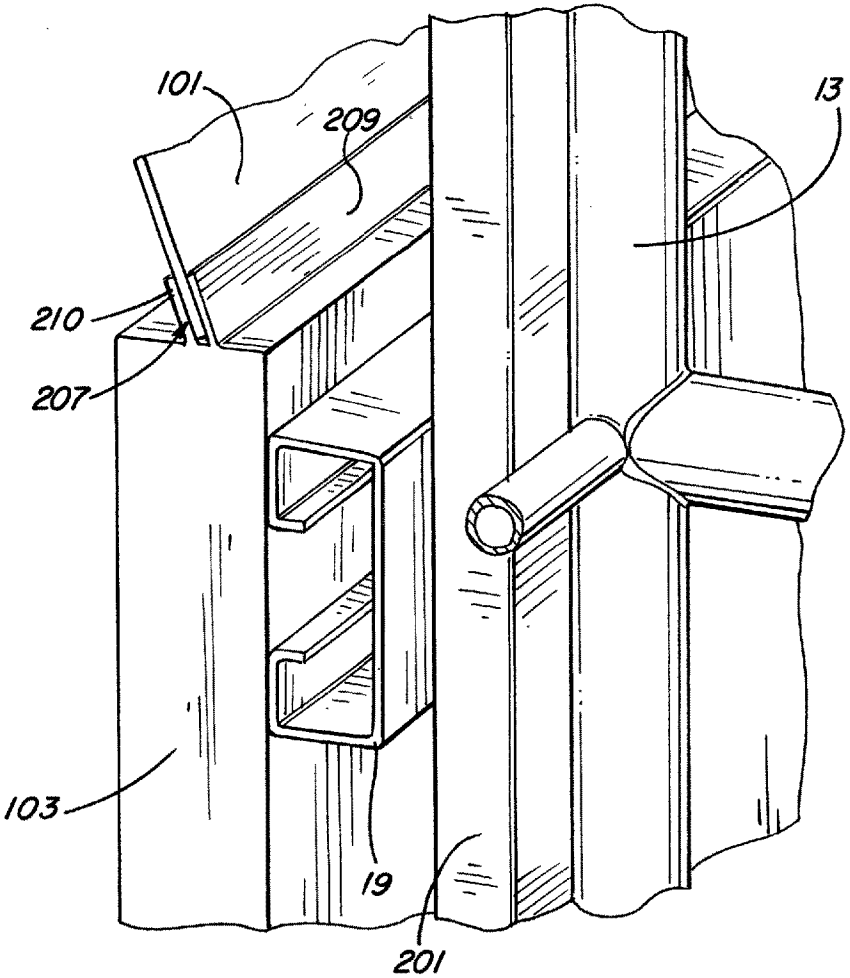
FIG. 39 is a fragmentary perspective view of structure for positioning and holding in place display support panels according to an illustrative embodiment.

FIGS. 38-40 illustrate details of one embodiment of a truss structure and related components. FIG. 38 illustrates one mechanism for providing flexible "X-Y" (two dimensional) positioning of structural members of the displays of the illustrative embodiments. In particular, each vertical truss member 13 may have two vertical channels 201 welded thereto, each of which has a "C" shaped cross-section. The top horizontal rail 17, also of "C"-shaped cross-section, is positionable up and down the vertical length of the vertical channels 201 and may be locked in a selected position, using an anchor mechanism such as illustrated, for example, in FIG. 42. As further illustrated in FIG. 38, each cantilever support 39 has a vertical planar surface 204, which forms into a channel 205 of U-shaped cross-section. Utilizing this construction, the cantilever supports 39 may simply be hooked onto the horizontal rail 17 and then raised or lowered to any height as desired. Additionally, the cantilever supports 39 and display components attached thereto may be simply slid to the left or right, contributing further to the universal positioning capability of the structure. Other accessory components beside the cantilever supports 39 can be similarly hooked or otherwise slidably mounted in the upper channel 17. In particular, bump outs, e.g., 67 or 167, may be so mounted. In one embodiment, each of the horizontal rails, e.g., 17, 19, 21, 23, 25, 27, 29, are identically shaped.

Figure 41:
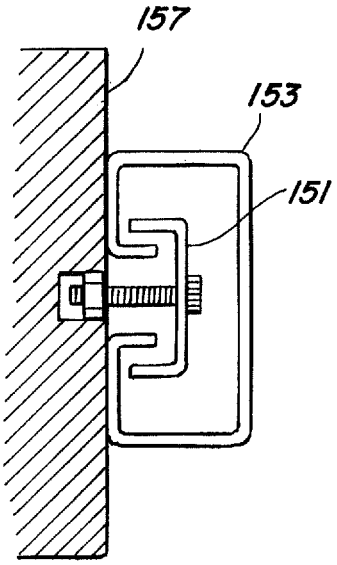
FIG. 41 is a side view of an embodiment of an anchor mechanism.
Figure 42:
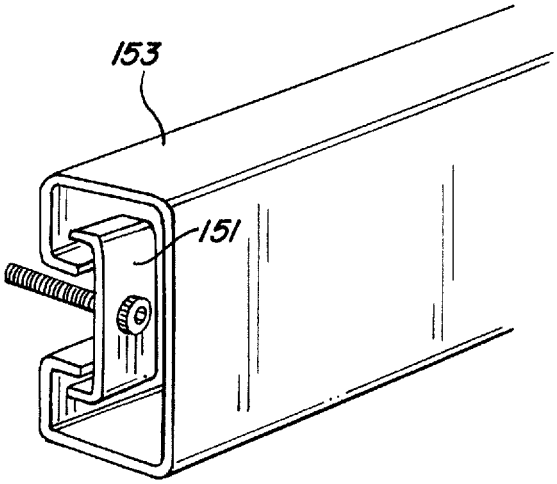
FIG. 42 is a perspective view of the mechanism of FIG. 41.
Figure 43:
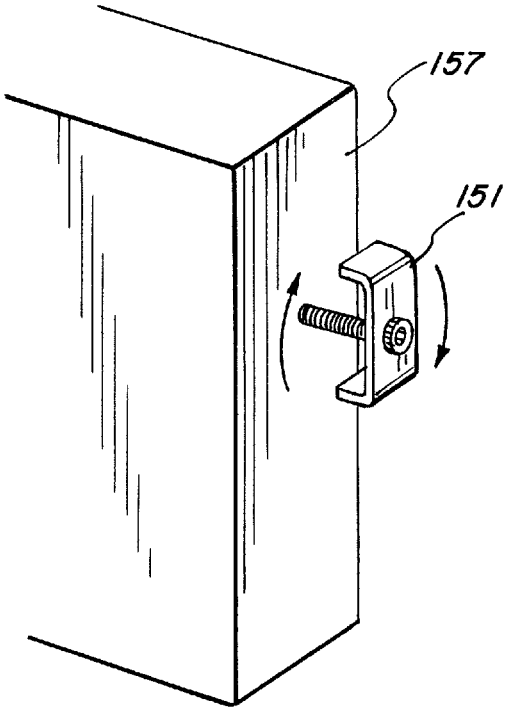
FIGS. 43 and 44 are perspective views illustrating operation of the mechanism of FIGS. 41 and 42.
Figure 44:
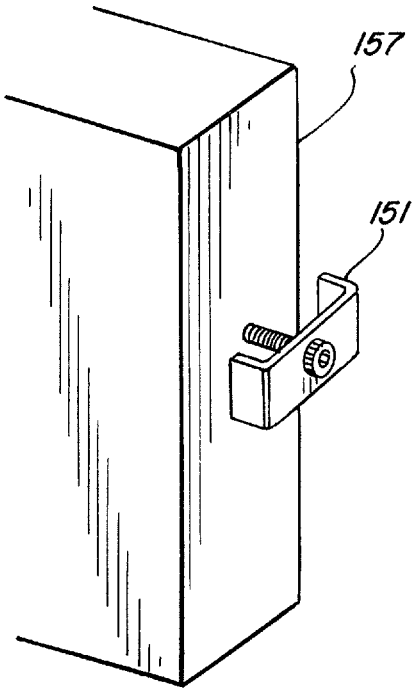

FIG. 39 further illustrates component attachment mechanisms for the displays of the illustrative embodiments. In particular, a display support panel 103 is shown attached to a "C-shaped" horizontal rail, e.g. 19, which rail 19 is slidable up and down in the vertical channels 201 and fastenable in any position via a suitable mechanism, e.g., as illustrated in FIG. 42. The display support panel 103 is further attached to the horizontal rail 19, for example, as illustrated in FIG. 41. A second display support panel, e.g., a graphic header 101, is slidably inserted into an angled slot 207 formed by spaced-apart rectangular parallel planar surfaces 209, 210, which may be unitarily formed as part of the display support panel 103 in one embodiment.

FIG. 40 illustrates one embodiment for attaching the lower cabinets 87 to the display support structure. In this embodiment, the cabinets 87 slidably ride on the floor track 31 and are slidable to the left and to the right in horizontally rails 27 and 29. The cabinets 87 may be attached to the rails 27, 29 and the rails 27, 29 to the vertical rails 201 in the same manner as discussed with respect to FIG. 38.

Figure 49:
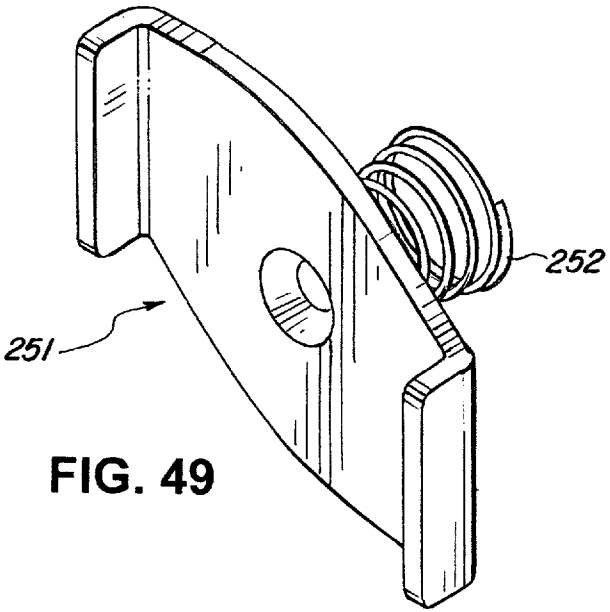
FIG. 49 is a perspective view of a spring loaded attachment component.
Figure 50:
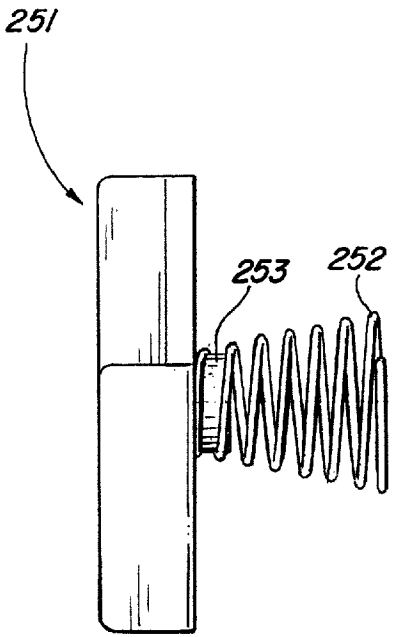
FIG. 50 is a side view of the component of FIG. 49.

FIGS. 41-44 illustrate one embodiment of an anchor mechanism. Here, a "U"-shaped member 151 is rotatable to a first position (FIG. 44) where it may be inserted into a slot in a "C"-shaped track 153. The "U"-shaped member 151 is then rotated to lock the attached structural component 157 to the channel 153 as shown in FIGS. 41 and 42. The "U-shaped" member 151 is spring loaded or mechanically captured so as to pull it towards the surface 157, thereby locking the member 151 in the channel 153. In another embodiment, the member 151 could be "T-shaped" rather than U-shaped. FIGS. 49-50 illustrate another embodiment of a spring loaded "U"-shaped member 251. In this embodiment, a conical tapered coil spring 252 is press-fitted onto an extruded nut, which may be threaded onto a threaded stud attached to a structural member of the display, for example, as illustrated FIG. 43.

Figure 45:
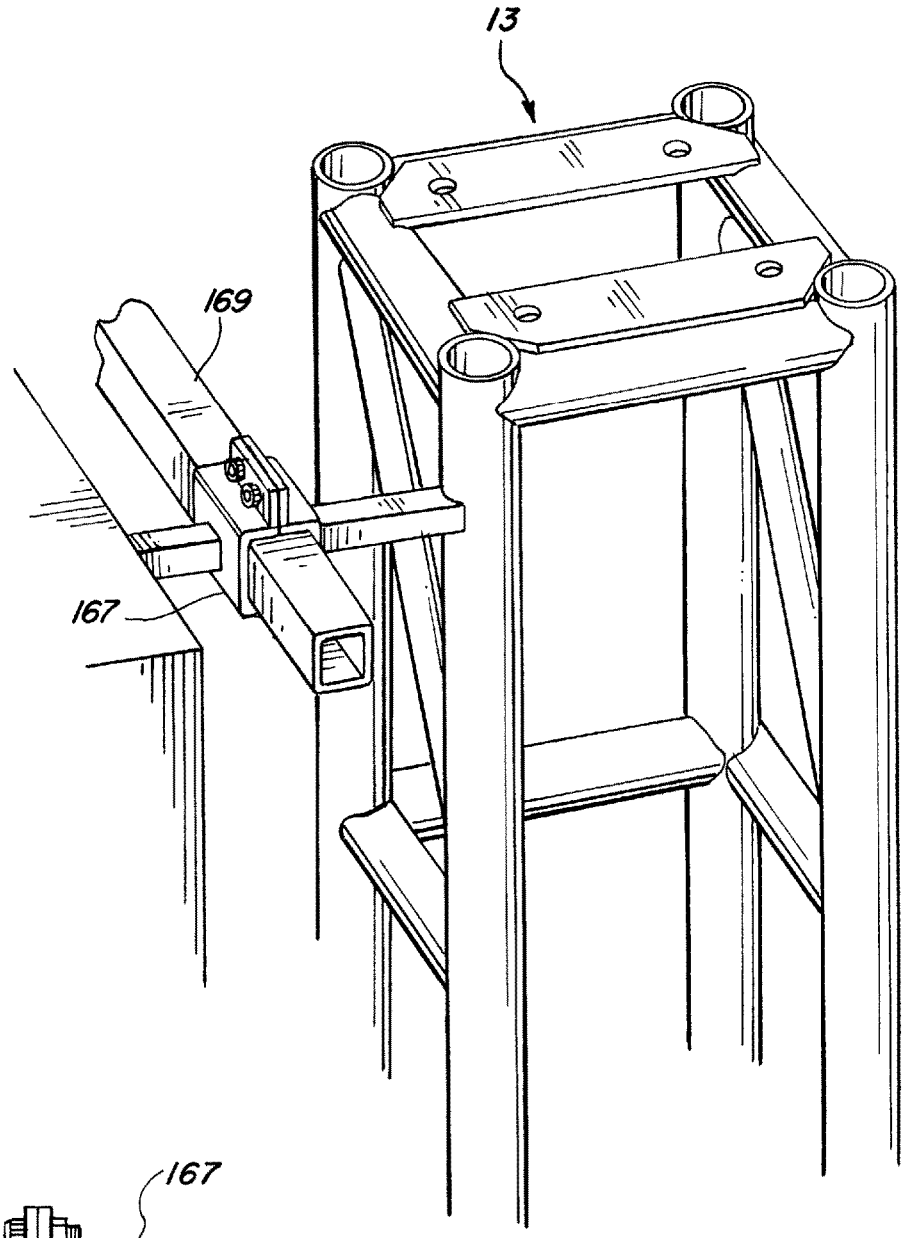
FIG. 45 is a fragmentary perspective view of an alternate display and attachment mechanism embodiment.
Figure 46:
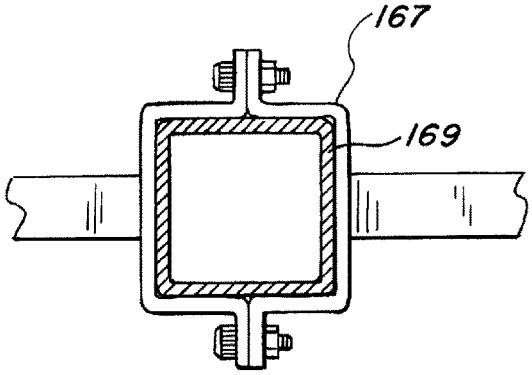
FIG. 46 is an end sectional view of the embodiment of FIG. 45.
Figure 47:
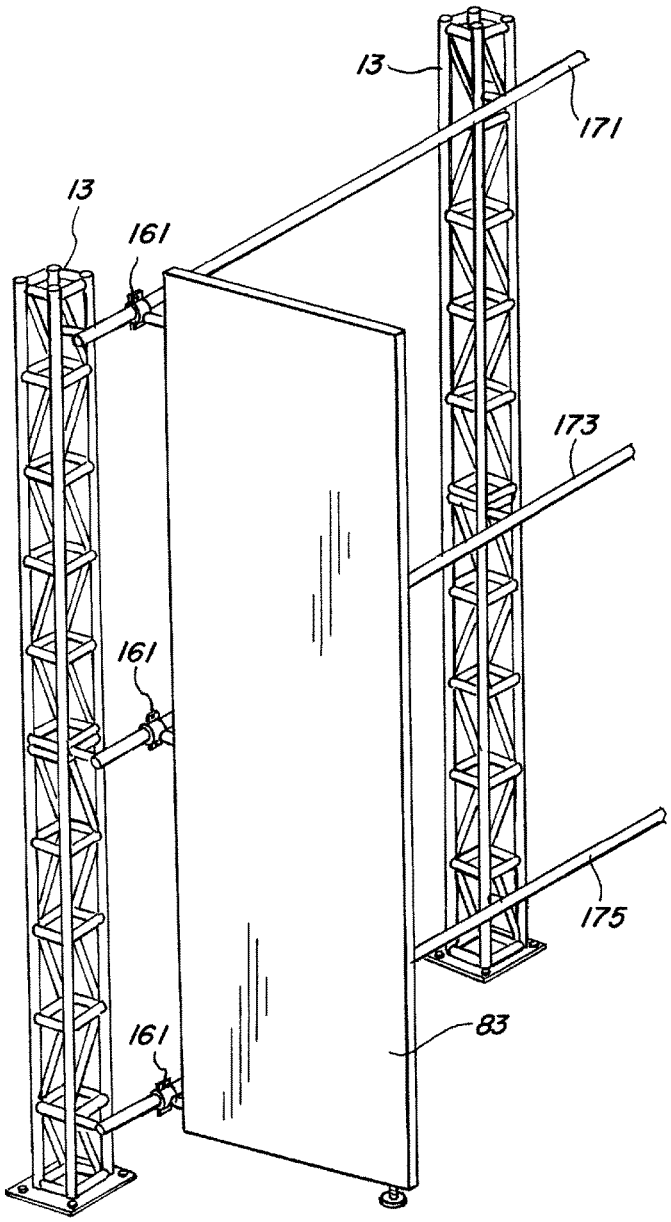
FIG. 47 is a fragmentary perspective view of an alternate display and attachment mechanism embodiment.
Figure 48:
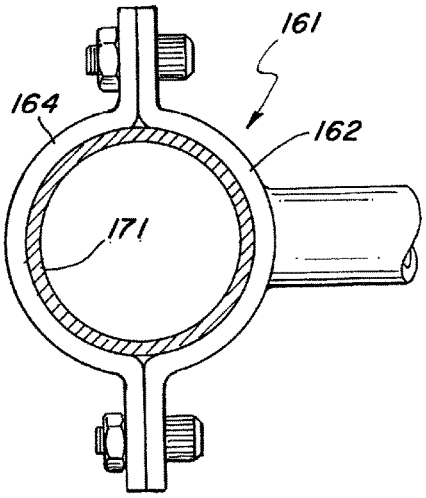
FIG. 48 is an end sectional view of the embodiment of FIG. 47.

FIGS. 47 and 48 illustrates a second locking or anchor mechanism for attaching side panels, e.g., 83 to horizontal rails 171, 173, 175 where the rails 171, 173, 175 are cylindrical tubes. This mechanism comprises a two part "horseshoe" clamp 161. One half 162 of the clamp 161 is attached to the side panel 83 and is then placed in position against and around the tube, e.g., 171. The second portion 164 of the clamp 161 is then bolted on to the first portion to attach the panel to the rail. In another embodiment, shown in FIGS. 45 and 46, square rails and a rectangular cross-section clamp 167 are used. This embodiment has the advantage of avoiding rotation of the parts 167, 169 with respect to one another.

Figure 51:
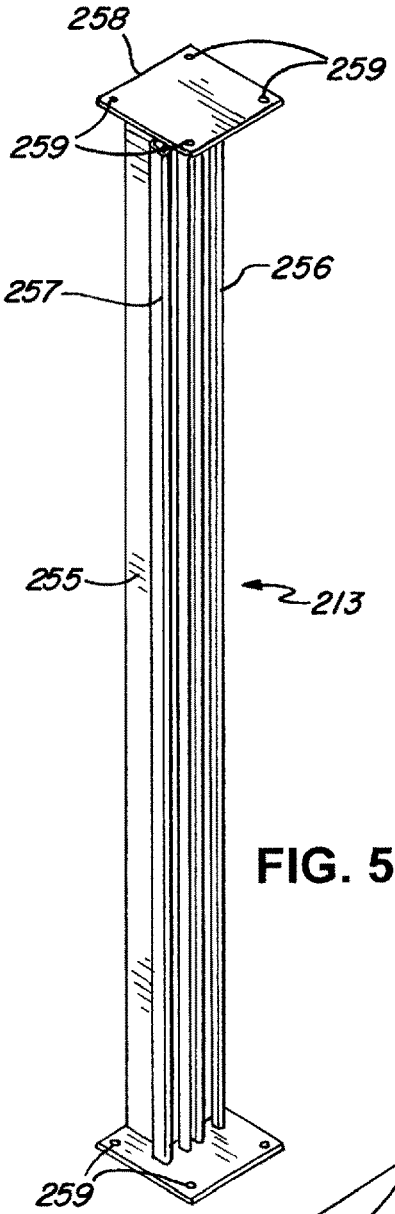
FIG. 51 is a perspective view of an alternate vertical truss member embodiment.
Figure 52:
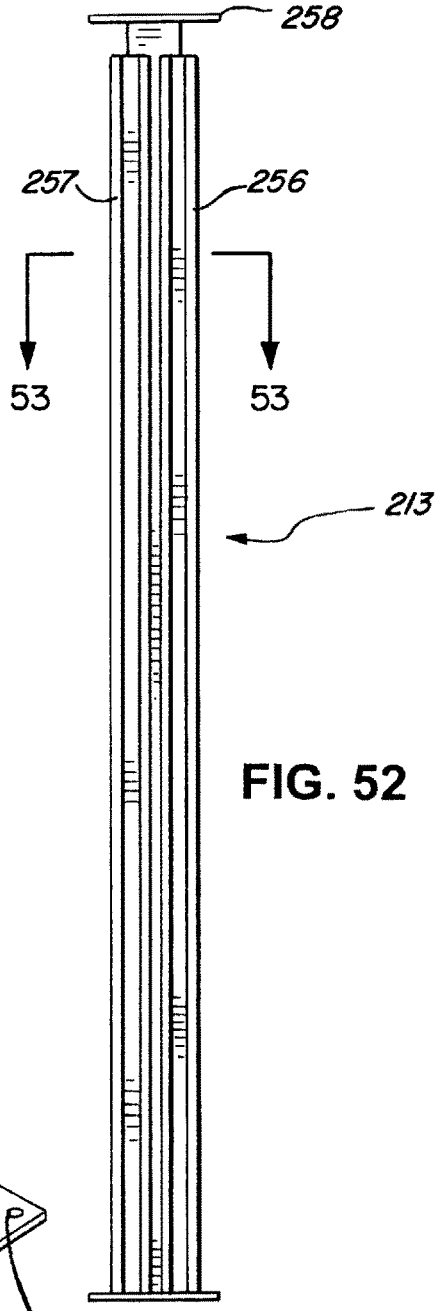
FIG. 52 is a front view of the truss member of FIG. 51.

FIGS. 51 and 52 illustrate an alternate embodiment of a vertical tube support 213, which may be used in place of the vertical truss members 13. In one embodiment, the tube support includes a 4 inch by 4 inch square steel tube 255, which is 0.125 inch in sidewall thickness. Two "C" shaped vertical steel channels 256, 257 are welded or otherwise attached to the tube 255. The tube 255 may have different dimensions in other embodiments, and may be formed of materials other than steel. The tube support 213 may further have flat horizontal top and bottom plates 257, 258 fixedly attached thereto, with suitable bolt holes, e.g. 259 formed therein. In one embodiment, a first tube support 213 may be eight feet high and a second tube support similarly constructed may have its bottom plate bolted to the top plate 259 of the first tube support 213 to provide a taller display, for example, from 12 to 16 feet tall.

Figure 53:
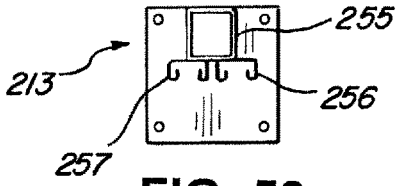
FIG. 53 is a sectional view taken at 53-53 of FIG. 52.
Figure 54:
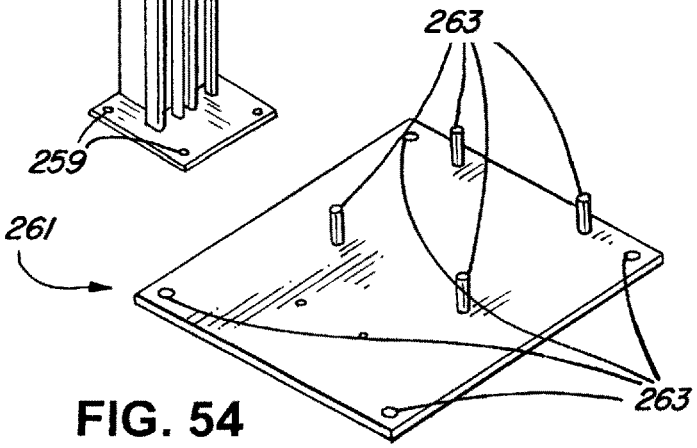
FIG. 54 is a perspective view of a base mounting plate according to an illustrative embodiment.

FIG. 54 illustrates a base mounting plate 261 for use with the tube support 213 of FIGS. 51-53. This mounting plate includes four vertical studs 263, which mate with respective holes 259 of the base plate 257 of the tube support 213. In one embodiment, suitable nuts may be threaded onto the studs 263 to attach the tube support. The base mounting plate 61 also includes four mounting holes 265. These mounting holes may receive threaded vertical studs embedded, for example, in a concrete floor to facilitate attachment of each tube support 213 to the floor.

Those skilled in the art will appreciate that various adaptations and modifications of the just described preferred embodiment can be configured without departing from the scope and spirit of the invention. Some embodiments may employ displays, digital interactive devices, and other features such as those disclosed in U.S. Provisional Patent Application No. 61/330,505 entitled Interactive Color Center Display Apparatus, which is incorporated by reference in its entirety herein. Therefore, it is to be understood that, within the scope of the appended claims, the invention may be practiced other than as specifically described herein.

The invention claimed is:

1. An adjustable truss structure for a display comprising:

a vertical truss member;

a vertical channel having a vertical slot therein, the vertical channel being attached to the vertical truss member;

a horizontal rail having a horizontal slot;

an anchor attached to the horizontal rail, the anchor having a member rotatable to a first position where the member is insertable into the vertical slot and rotatable to a second position to engage with a surface of the vertical channel, thereby enabling the horizontal rail to be selectively moved up and down the vertical channel and locked into a selected fixed position with respect to the vertical channel; and a support member having a channel with a U-shaped cross-section, the channel of the support member being hooked into the horizontal slot of the horizontal rail and being horizontally slidable in the horizontal slot.

2. The adjustable truss structure of claim 1 wherein the member of the anchor is spring loaded with a spring that is press-fitted onto an extruded nut configured to thread onto a threaded stud attached to the horizontal rail, the spring forcing the member of the anchor against the surface of the vertical channel.

3. The adjustable truss structure of claim 2, wherein the spring is a conical tapered coil spring.

4. The adjustable truss structure of claim 2, wherein the member of the anchor has a U-shaped cross-section.

5. The adjustable truss structure of claim 1, wherein the vertical channel has a C-shaped cross-section.

6. The adjustable truss structure of claim 1, further comprising a display support panel attached to the horizontal rail.

7. The adjustable truss structure of claim 6, wherein the display support panel includes an angled slot on a top surface thereof.

8. The adjustable truss structure of claim 7, further comprising a graphic panel that is inserted in the angled slot.

9. The adjustable truss structure of claim 7, wherein the angled slot is unitarily formed with the display support panel.

10. The adjustable truss structure of claim 1, further comprising a floor track with a horizontal slot in a top surface thereof, the floor track being located adjacent to the vertical truss member.

* * * * *